US012760608B2

(12) United States Patent
Cook et al.

(10) Patent No.: US 12,760,608 B2
(45) Date of Patent: Oct. 13, 2026

(54) REEL DEPLOYMENT FOR CENTRALIZED PAD SYSTEM

(71) Applicant: FMC Technologies, Inc., Houston, TX (US)

(72) Inventors: James Cook, Houston, TX (US); Corey Massey, Houston, TX (US); Julian Keihany, Houston, TX (US); Thiago Machado, Houston, TX (US); Rajeev Pillai, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 18/968,720

(22) Filed: Dec. 4, 2024

(65) Prior Publication Data

US 2025/0092745 A1 Mar. 20, 2025

Related U.S. Application Data

(62) Division of application No. 17/934,133, filed on Sep. 21, 2022, now Pat. No. 12,196,048.

(51) Int. Cl.
*E21B 19/22* (2006.01)
*B65H 75/42* (2006.01)

(52) U.S. Cl.
CPC ..... *E21B 19/22* (2013.01); *B65H 75/42* (2013.01)

(58) Field of Classification Search
CPC ..... E21B 19/22; B65H 75/42; B65H 75/425
See application file for complete search history.

(56) References Cited

U.S. PATENT DOCUMENTS

| | | | | |
|---|---|---|---|---|
| 4,148,445 | A * | 4/1979 | Reynolds | B65H 75/4407 242/397.2 |
| 7,841,394 | B2 * | 11/2010 | McNeel | E21B 43/267 166/305.1 |
| 10,865,068 | B2 * | 12/2020 | Dion | B65H 75/4486 |
| 11,242,217 | B1 * | 2/2022 | Leger | B65H 75/425 |
| 11,525,316 | B2 * | 12/2022 | Lee | B65H 49/34 |
| 12,196,048 | B2 | 1/2025 | Cook et al. | |

FOREIGN PATENT DOCUMENTS

CN 212425012 U 1/2021

OTHER PUBLICATIONS

Office Action issued in corresponding AE Application No. P6002384/23 dated Apr. 29, 2025 (7 pages).
Office Action issued in Saudi Arabian Application No. 123450435, mailed on Apr. 13, 2025 (8 pages).

* cited by examiner

*Primary Examiner* — Matthew R Buck
(74) *Attorney, Agent, or Firm* — Osha Bergman Watanabe & Burton LLP

(57) ABSTRACT

A pipe deployment system includes a vehicle, a deployment tool having a body with a spool engagement slot and a hydraulic motor mounted to the body, a spool having a pin extending along a rotational axis of the spool from an end of the spool, and an engagement spline rotationally engaging the hydraulic motor with the pin. The deployment tool is removably connected to the vehicle.

12 Claims, 16 Drawing Sheets

REEL DEPLOYMENT FOR CENTRALIZED PAD SYSTEM

BACKGROUND

Well systems generally include one or more wells accessing an underground formation and a system of pipes and vales used to control fluids into and out of the well(s). One or more pumps may be used to pump fluids, e.g., drilling fluids or fracing fluids, into a well. Additionally, fluids coming out of a well, such as returning drilling fluid or production fluids, may be directed to various equipment around the well for collection (e.g., in a mud pit), processing (e.g., filtering, production operations, etc.), or recirculation. Equipment used in well systems are generally set up around a well to reduce transport inefficiencies.

As an example, a well system may be set up for a hydraulic fracturing operation. In general, hydraulic fracturing operations involve pumping a fracturing fluid under high pressure into the formation for purposes of creating cracks in the formation to thereby create fluid flow paths from the well to a larger area of the reservoir that contains the hydrocarbons to be produced. More specifically, a hydraulic fracture is formed by pumping a fracturing fluid into the well at a rate sufficient to increase the pressure downhole to a value that is greater than the fracture gradient of the formation. The pressure of the fracturing fluid cause the formation to crack, thereby allowing the fracturing fluid to enter and extend the crack further into the formation. In some cases, depending upon the application, the cracks formed during such a fracturing operation may radiate a great distance away from the well and into the formation. The fracturing fluid can comprise any type of fluid, ranging from water to gels, foams, nitrogen, carbon dioxide, or air in some cases along with different forms of diluted acid. To keep the fractures in the formation open after the fracture is initially formed, so-called propping agents or "proppants" (typically small spheres generally composed of quartz sand grains, ceramic spheres or aluminum oxide pellets) are introduced into the fracturing fluid and pumped into the fractures to extend the fractures and pack them with proppants. At a very basic level, the proppants act to keep the fracture "propped" open when the pressure on the fracturing fluid is eliminated or reduced. Typically, the proppant is made of a material that is higher in permeability than the surrounding formation. Accordingly, the propped hydraulic fracture becomes a high permeability conduit through which the formation fluids can flow into the well.

FIG. 1 depicts an illustrative example of various items of equipment that are typically part of a conventional fracturing system 10 used in fracturing operations and also depicts one illustrative example of how such fracturing equipment may be arranged and positioned on-site when performing a fracturing operation. In general, the equipment used in hydraulic fracturing operations includes, among other things, a blender 12, a plurality of water tanks 14, a plurality of proppant or sand containers 16, a data monitoring van 18, a pump manifold 20 (sometimes referred to as a missile manifold), a plurality of pump trucks 22 each of which has a high-pressure frac pump 24 and a plurality of high-pressure fluid flow lines 26. In the depicted example, there are a total of twelve such trucks 22—six on each side of the pump manifold 20. In operation, the blender 12 is adapted to prepare or mix the fracturing fluid to be injected into the formation. The blender 12 may receive water from the water tanks 14 and various chemical additive and/or proppants/sand from the containers 16 and mix all of these materials together. The final fracturing fluid is provided from the blender 12 to the low-pressure inlet side of the frac pumps 24 via various low-pressure flow lines (not shown). The frac pumps 24 are operated so as to generate a high-pressure fracturing fluid that is injected into the pump manifold 20 via various high-pressure flow lines 26. The high-pressure fracturing fluid flows from the pump manifold 20 to the well 28 where it is ultimately injected into the formation. The data-monitoring van 18 comprises equipment and sensors that enable personnel to monitor the fracturing process. The job site area in which the fracturing system 10 is set up is often referred to as a "pad."

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to well systems that include a pump pad and a first well pad having a first well, wherein the first well pad is remote from the pump pad. The pump pad may include a plurality of hydraulic pumps fluidly connected to a pump manifold and a pad selection manifold fluidly connected to the pump manifold. A first line of flexible pipe may fluidly connect the pump manifold and the first well. Well systems disclosed herein may also include a control system having a central operation system located on one of the pump pad or the first well pad and a remote operation system located on the other of the pump pad or the first well pad. The central operation system may include a primary computer system with a primary user interface, and the remote operation system may include a remote computer system in communication with the primary computer system and electronic controllers.

In another aspect, embodiments disclosed herein relate to methods that include providing a spool of flexible pipe on a deployment tool, attaching a first end of the flexible pipe to a pump manifold in a pump pad, moving the deployment tool in a direction away from the pump pad while the first end of the flexible pipe is connected to the manifold to unreel the flexible pipe from the spool, and using a hydraulic motor mounted to the deployment tool to control tension in the flexible pipe as the flexible pipe is unreeled from the spool.

In yet another aspect, embodiments disclosed herein relate to pipe deployment systems that include a vehicle, a deployment tool attached to the vehicle, the deployment tool having a body with a spool engagement slot and a hydraulic motor mounted to the body, a spool having a pin extending along a rotational axis of the spool from an end of the spool, and an engagement spline rotationally engaging the hydraulic motor with the pin.

Other aspects and advantages of the claimed subject matter will be apparent from the following description and the appended claims.

Figure 1:
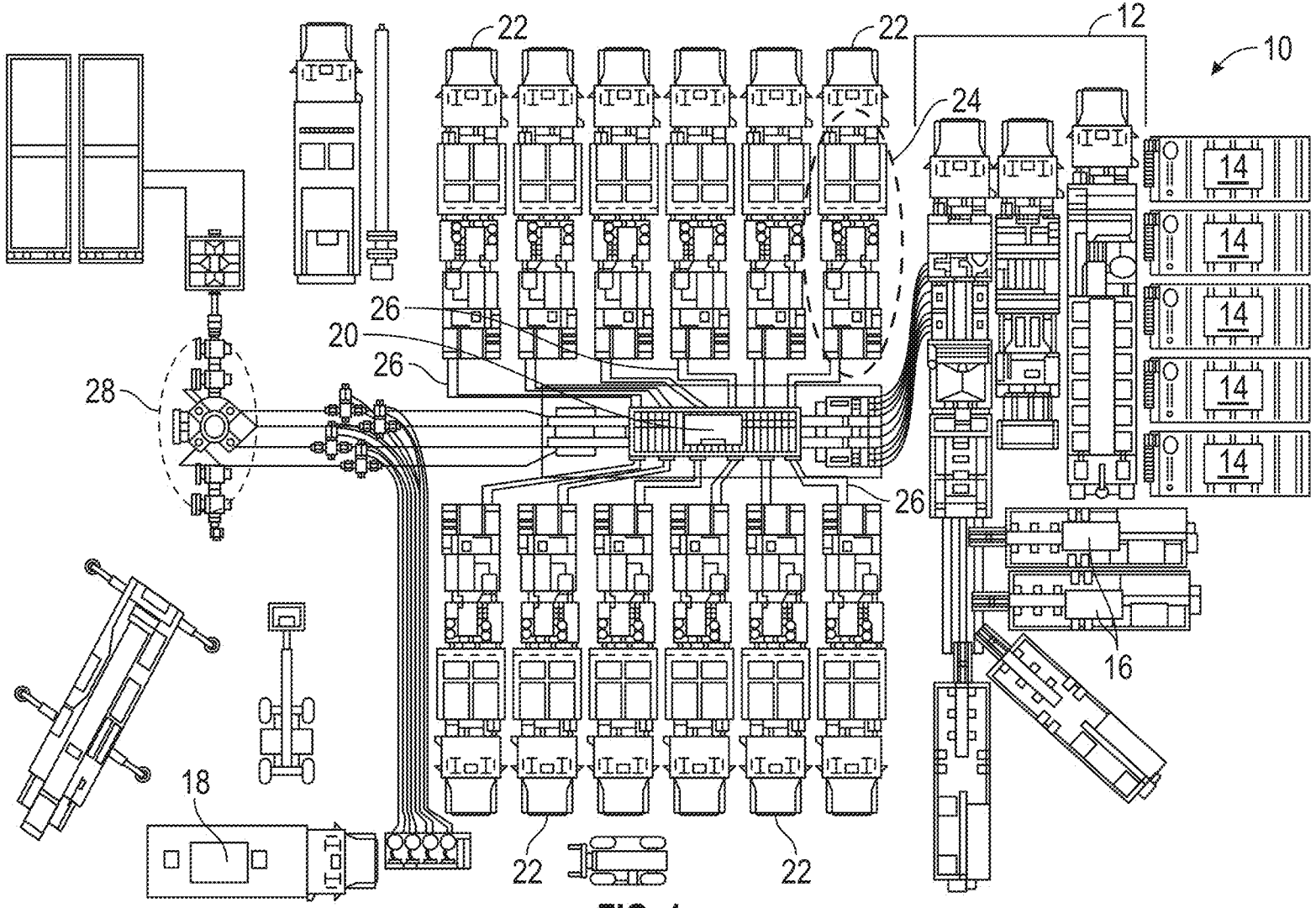
FIG. 1 (Prior Art)
FIG. 1 shows a conventional well system.

In the description of FIGS. 1-23, any component described with regard to a figure, in various embodiments disclosed herein, may be equivalent to one or more like-named components described with regard to any other figure. For brevity, descriptions of these components may not be repeated for each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In one aspect, embodiments disclosed herein relate to well systems and methods for setting up well systems that include a single pump location that may be used to pump fluids to one or more different well locations located remotely from the pump location. A pump location may be fluidly connected to different well locations using flexible pipe, which may be installed using flexible pipe deployment systems described herein.

Well System Layout and Operation

Well systems may generally include one or more wells and operational equipment fluidly connected to the well(s) to perform one or more well operations such as drilling operations or hydraulic fracturing. Well systems according to embodiments of the present disclosure may include one or more well site locations (referred to herein as well pads) fluidly connected to pumping equipment at a spaced apart location (referred to herein as a pump pad) and a control system for controlling equipment and fluid flow through the well system. The control system may include a central operation system located on one of the pads in the well system and a remote operation system located on the other pad(s) in the well system, where the central operation system may be used to control equipment in any of the pads in the well system via the remote operation system(s).

Figure 2:
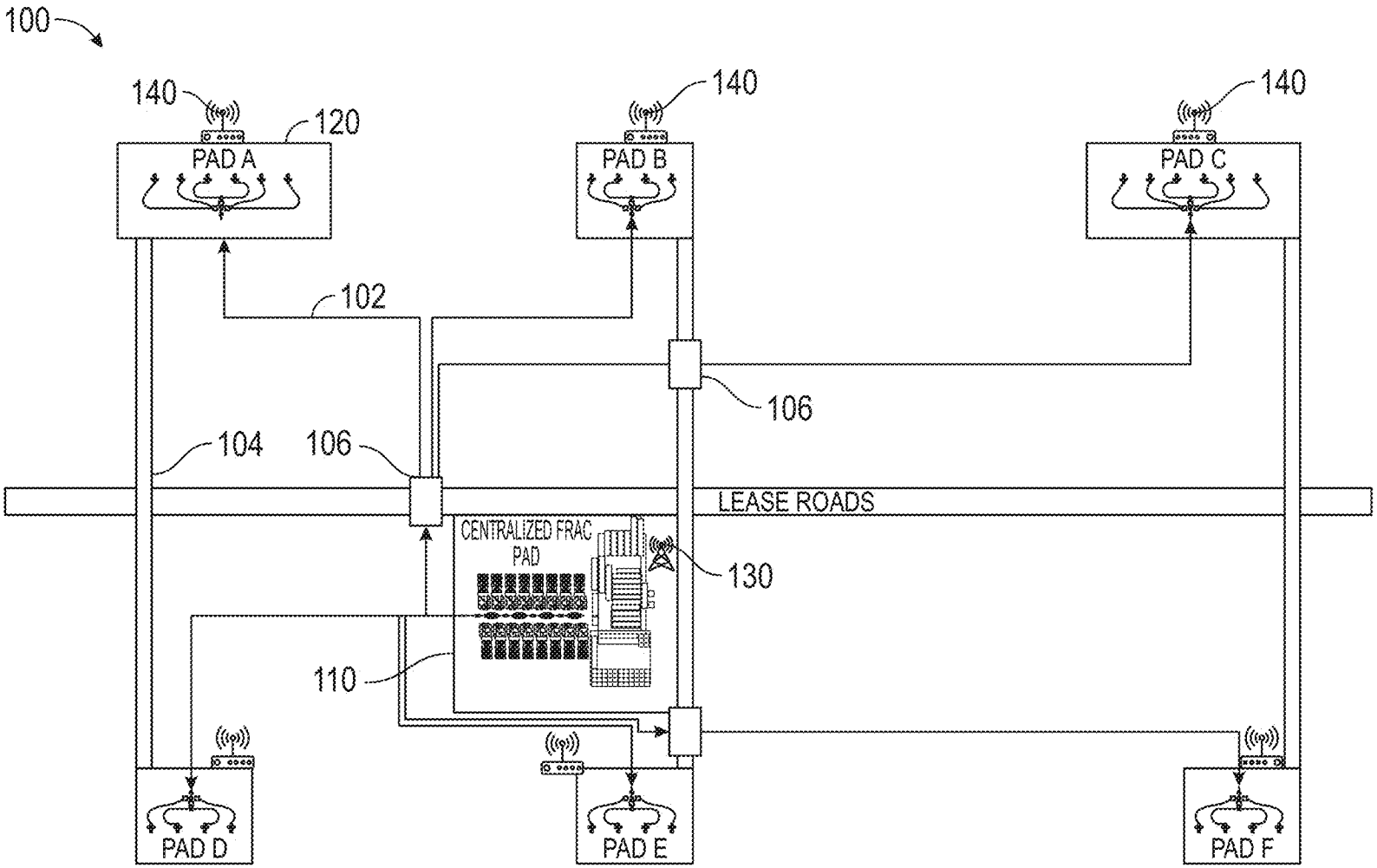
FIGS. 2-4 show a well system according to embodiments of the present disclosure.

FIG. 2 shows an example of a well system 100 according to embodiments of the present disclosure. The well system 100 shown in FIG. 2 is a well system set up for hydraulic fracturing operations. However, other types of well systems including one or more well sites may be envisioned. The well system 100 includes a pump pad 110 and multiple well pads 120 fluidly connected to the pump pad 110 using flexible pipe 102.

Flexible pipe generally refers to multi-layer pipe that is both flexible and capable of holding high pressure fluid therein, e.g., between 1,000-20,000 psi. For example, flexible pipe may be formed of concentric and alternating layers of plastic (e.g., thermoplastic materials such as Teflon, polyether ether ketone (PEEK), or polyvinylidene difluoride (PVDF)), fabrics, composites (e.g., a polymer matrix having carbon fibers and/or glass therein), and/or metal (e.g., steel or carbon steel).

Flexible pipe may have various internal and external diameters, for example, ranging between 2 and 7 inches. Additionally, flexible pipe may be formed in segments with connections (e.g., clamp connectors and/or threaded connections) at opposite axial ends. Segments of flexible pipe may be connected together in an end-to-end manner at their connections to form lines of flexible pipe having a total length. For example, common lengths of flexible pipe segments may range between 100 and 800 feet. Multiple segments of flexible pipe may be connected together to form a longer line of flexible pipe having a total length appropriate for the selected application.

Referring again to FIG. 2, a pump pad 110 may be spaced apart from one or more of the fluidly connected well pads 120. For example, in some embodiments, a pump pad 110 may be located at least 100 feet away from a well pad 120, e.g., up to 1,000 feet, 2,000 feet, 4,000 feet, or more away from the well pad 120. In some embodiments, the pump pad 110 may be located in a central location to multiple different well pads 120 to minimize any one distance between the pump pad 110 and a well pad 120 over the distance from the pump pad 110 to other well pads 120. Because well pads 120 may be spaced large distances apart, roads 104 may be provided between the different locations for vehicle transport of personnel and equipment. Additionally, in some embodiments, roads 104 may be provided with culverts 106 to allow flexible pipe 102 or other conduits under the road 104.

Figure 3:
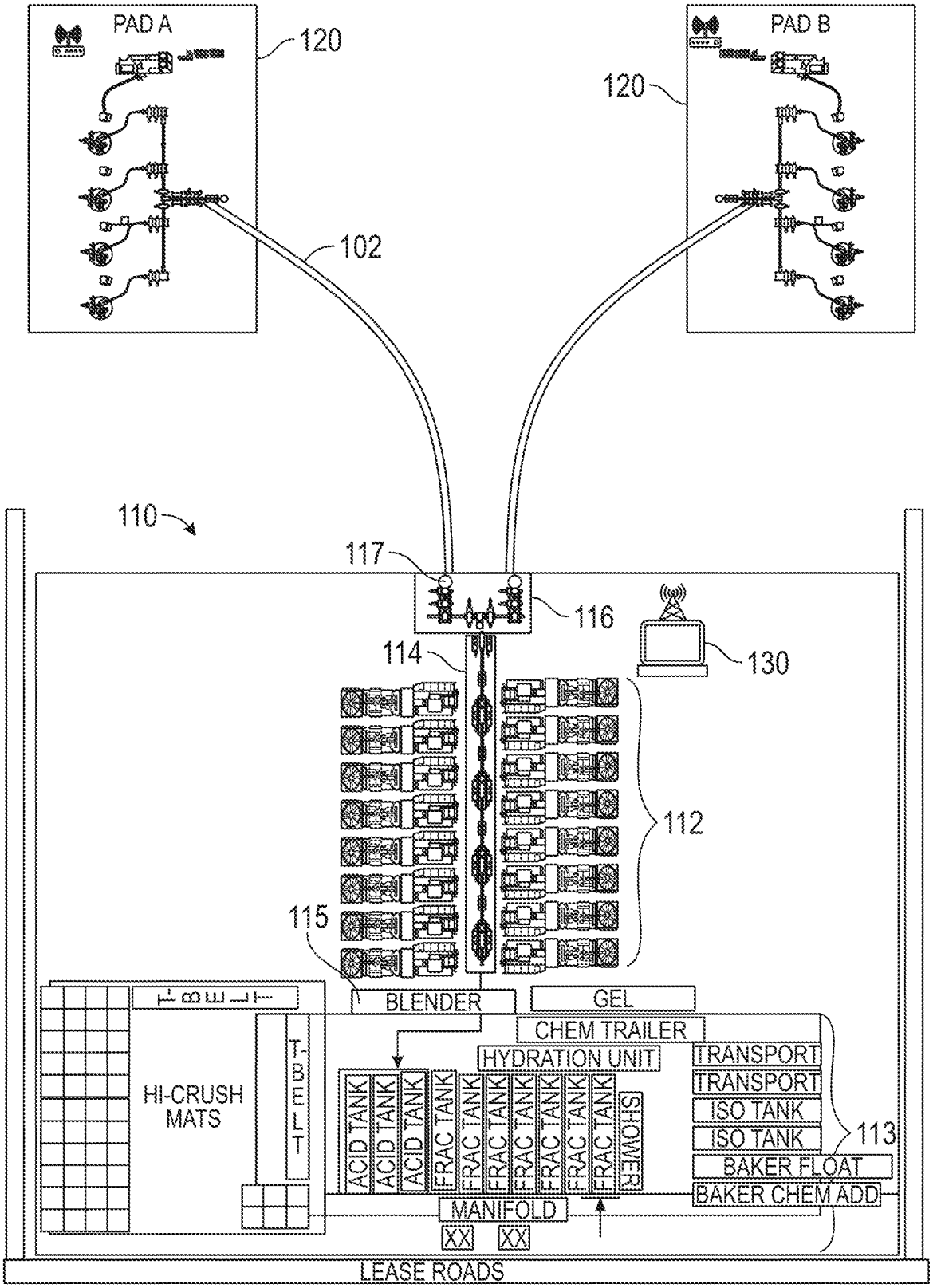
Figure 4:
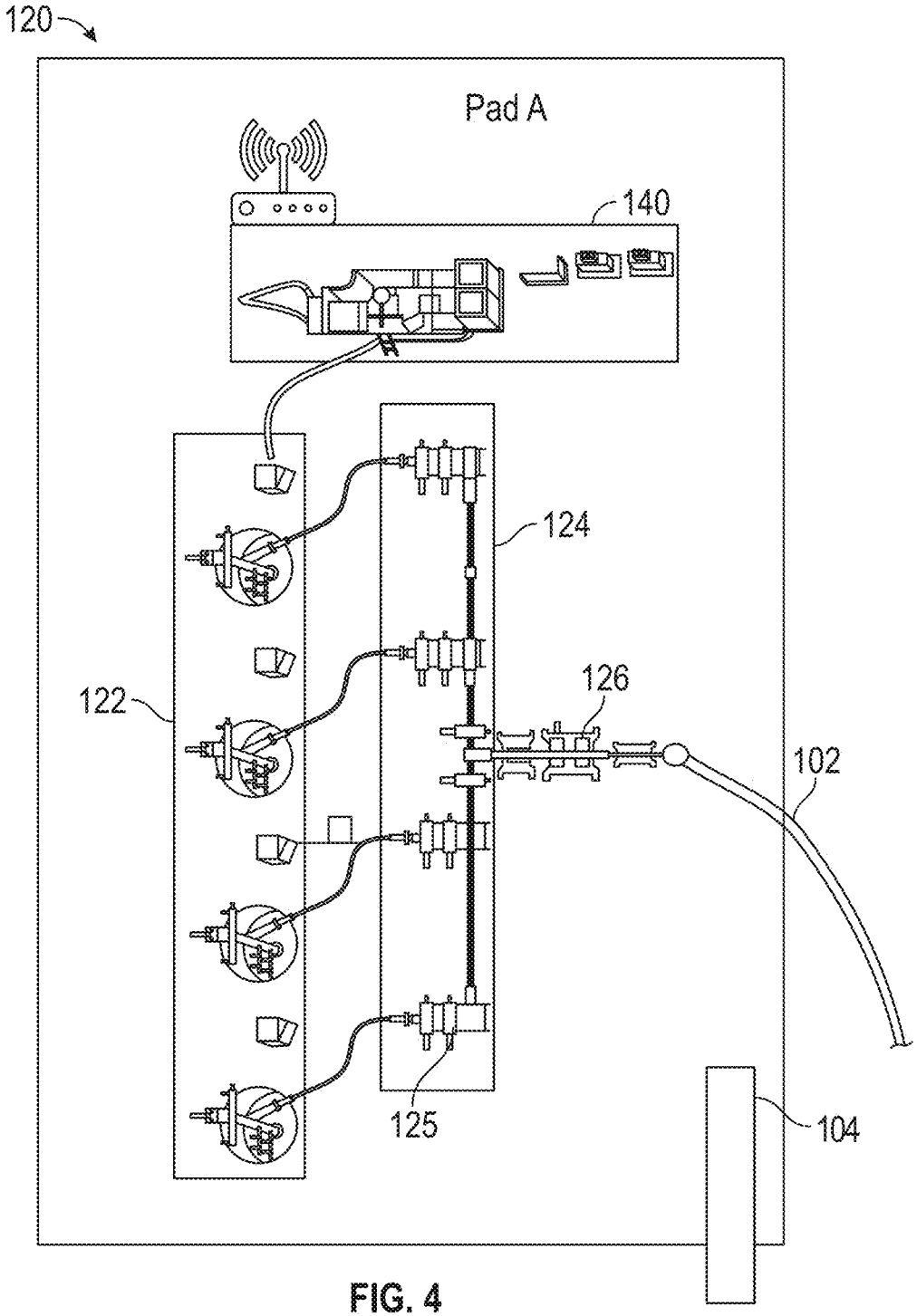

As used herein, a pad may refer to an area occupied by equipment necessary for performing an operation in the well system. For example, a pump pad may refer to an area occupied by pumping equipment and other associated equipment used in support of pumping fluids to another location, while a well pad may refer to an area occupied by wells and corresponding well equipment. FIG. 3 shows a more detailed view of the pump pad 110 shown in FIG. 2, and FIG. 4 shows a more detailed view of a well pad 120 shown in FIG. 2.

As shown in FIG. 3, the pump pad 110 may include a plurality of pumps 112 (e.g., hydraulic pumps for hydraulic fracturing) fluidly connected to a pump manifold 114. The pump manifold 114 may be an arrangement of flow fittings and valves installed downstream of the pump 112 outlets, where each pump 112 outlet may be fluidly connected to separate pump manifold inlets. Fluid may flow from one or more of the connected pumps 112 (e.g., through open valves) into a main flowline of the pump manifold 114. The fluid may then be directed from the main flowline of the pump manifold 114 to downstream equipment (e.g., to different well pads).

In hydraulic fracturing operations, the pumps 112 may pump a frac fluid designed for hydraulic fracturing made of a base fluid, proppant, and optionally, fluid additives, which may be supplied from various component supply sources 113 on the pump pad, such as a proppant supply, chemical additive supplies, and one or more base fluid supply tanks. The components may be mixed together using blender equipment 115 on the pump pad prior to being pumped through the pumps 112 to the pump manifold 114. Supply equipment may be provided on supply trucks, trailers, and or tanks. Additionally, supply equipment may be connected to the blender equipment 115 via pipes, hoses, and/or conveyors.

Fluid may be directed from the pump manifold to one or more well pads in the well system. In some embodiments, such as shown in FIG. 3, fluid may be directed from the pump manifold 114 to one or more well pads 120 via a pad selection manifold 116 fluidly connected to the pump manifold 114 and located in the pump pad 110. The pad selection manifold 116 (sometimes referred to as a zipper manifold) may include multiple valves 117 and associated piping operable in parallel to direct fluid to different well pads 120 fluidly connected to the pad selection manifold 116. The pad selection manifold 116 may be fluidly connected to multiple well pads 120 via flexible pipe 102, where separate lines of flexible pipe 102 may be connected to and extend from the pad selection manifold 116 to each of the multiple well pads 120. For example, a fluid may be pumped through the pumps 112 to the pump manifold 114, then to the pad selection manifold 116, and depending on which flow paths through the pad selection manifold 116 are open, then to a fluidly connected well pad 120 via a line of flexible pipe 102.

As best shown in FIG. 4, a well pad 120 may include one or more wells 122 accessing an underground formation and associated well equipment, such as casing, well tubing, well heads, etc. In embodiments where a well pad 120 has multiple wells, such as shown in FIG. 4, each well 122 may be fluidly connected to a well manifold 124. The well manifold 124 is a zipper manifold capable of selectively directing fluid to one or more of the connected wells 122. For example, the well manifold 124 may have a number of valve banks (including at least one valve and associated piping) corresponding to the number of connected wells 122, where each valve bank 125 in the well manifold 124 is connected to and controls fluid flow to different wells 122. In such manner, well(s) in a well pad 120 may be fluidly connected to flexible pipe 102 in the well system (and thus the pump pad 110) via a well manifold 124.

In some embodiments, a well pad 120 may also include an isolation manifold 126 connected between the well manifold 124 and a line flexible pipe 102 connected to the pump pad 110. The isolation manifold 126 may include a flow path fluidly connecting the flexible pipe connection to the well manifold 124 and at least one isolation valve along the flow path. When the isolation valve(s) is in an open configuration, a flow path fluidly connecting the flexible pipe to the well 122 is open, and when the isolation valve(s) is in a closed configuration, the flow path between the flexible pipe connection and the well manifold 124 may be entirely closed. An isolation valve may be used to stop fluid flow between the flexible pipe connection and well manifold, for example, when work is needed to be done to the well manifold 124 or one of the connected wells 122. Those of ordinary skill in the art may appreciate that different equipment, including different arrangements of valves, flowlines, and/or connections may be used to fluidly connect wells 122 to a flexible pipe 102 connection. The flexible pipe 102 may in turn fluidly connect the wells 122 to the pump pad 110.

Figure 5:
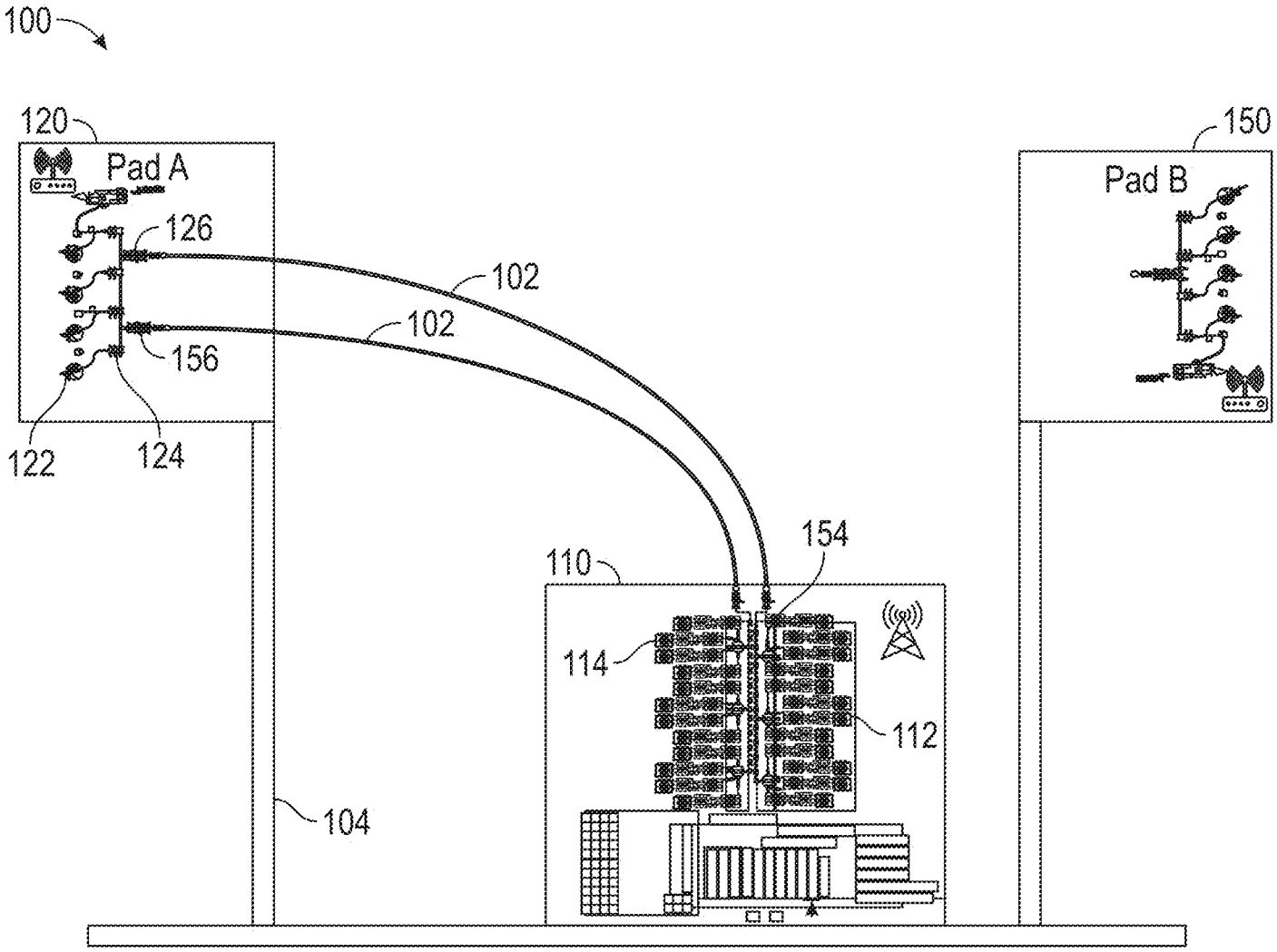
FIGS. 5 and 6 shows a well system according to embodiments of the present disclosure.
Figure 6:
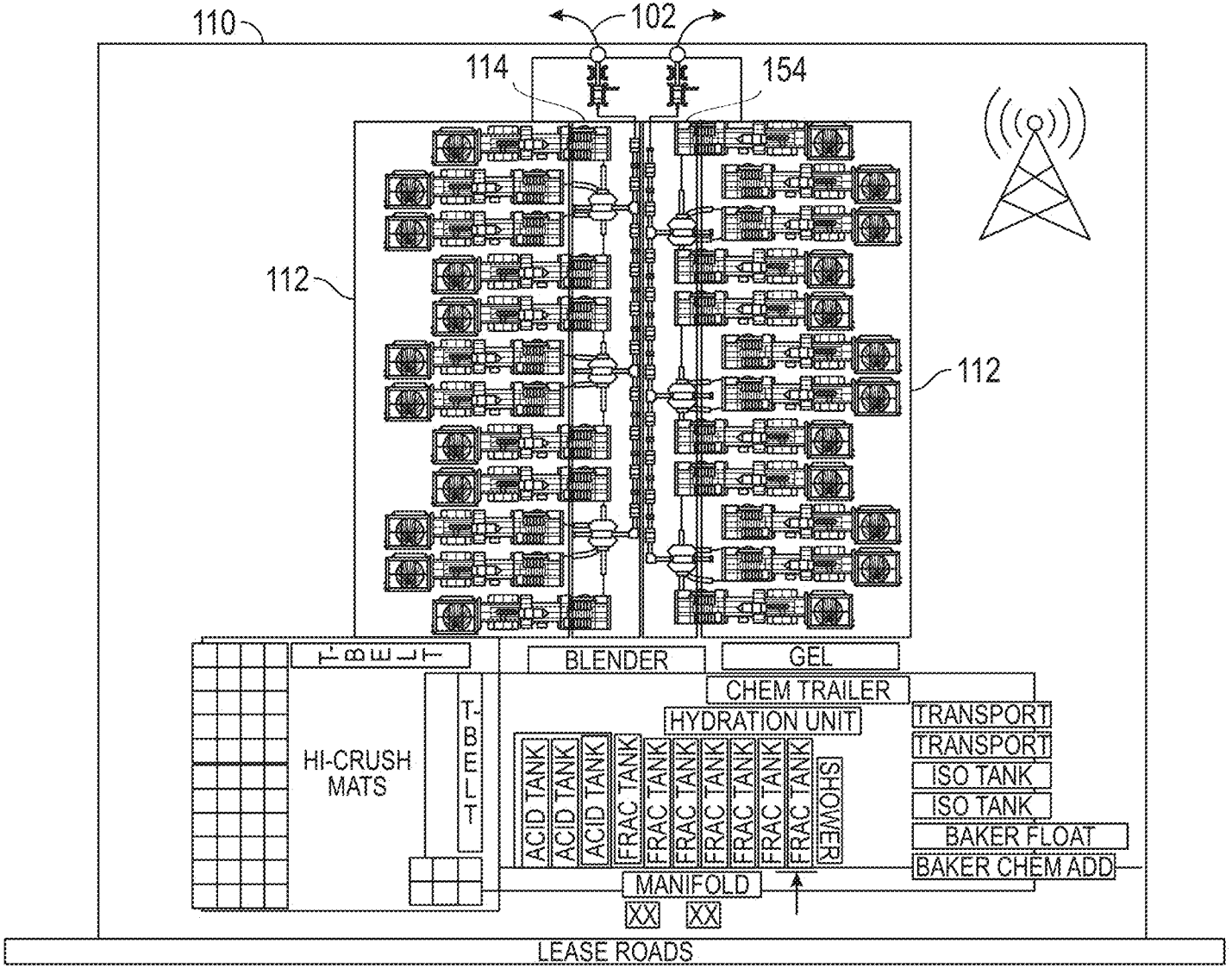

FIGS. 5 and 6 show another example of a well system 100 according to embodiments of the present disclosure. As shown, the well system 100 may include a pump pad 110 and well pads 120, 150 located remotely from the pump pad 110. The well pads 120, 150 and pump pad 110 may be accessible to each other via roads 104. The pump pad 110 may include a plurality of pumps 112 fluidly connected to two pump manifolds 114, 154. In such embodiments, a first set of the pumps 112 may be fluidly connected to a first pump manifold 114 and a second set of pumps 112 may be fluidly connected to a second pump manifold 154. The first set of pumps may be used to pump a first fluid through the first pump manifold 114, and the second set of pumps may be used to pump a second fluid through the second pump manifold 154. The first and second fluids may be different, e.g., different types of fracturing fluids.

Additionally, the first and second fluids may be pumped from the first and second pump manifolds 114, 154, respectively, into different wells in the same well pad or in different well pads. For example, in the embodiment shown in FIG. 5, a line of flexible pipe 102 may fluidly connect the first pump manifold 114 to a first well isolation manifold 126 in a first well pad 110, and another line of flexible pipe 102 may fluidly connect the second pump manifold 154 to a second well isolation manifold 156 in the same first well pad 120. The first and second well isolation manifolds 126, 156 may be fluidly connected to multiple wells 122 via a well manifold 124. This configuration may be used, for example, for pumping two separate fluid mixed into two different wells at the same time. In some embodiments, the second pump manifold 154 may be fluidly connected to well equipment in a different, second well pad 150. In the embodiment shown in FIGS. 5 and 6, the first and second pump manifolds 114, 154 may be arranged in parallel on the pump pad 110, where the first set of pumps 112 may be arranged on a side of the first pump manifold 114 opposite the second pump manifold 154, and the second set of pumps 112 may be arranged on the side of the second pump manifold 154 opposite the first pump manifold 114. Such arrangement may allow for space efficiency on the pump pad 110 and easier installation. However, other pump and manifold arrangements may be provided on a pump pad 110.

Figure 7:
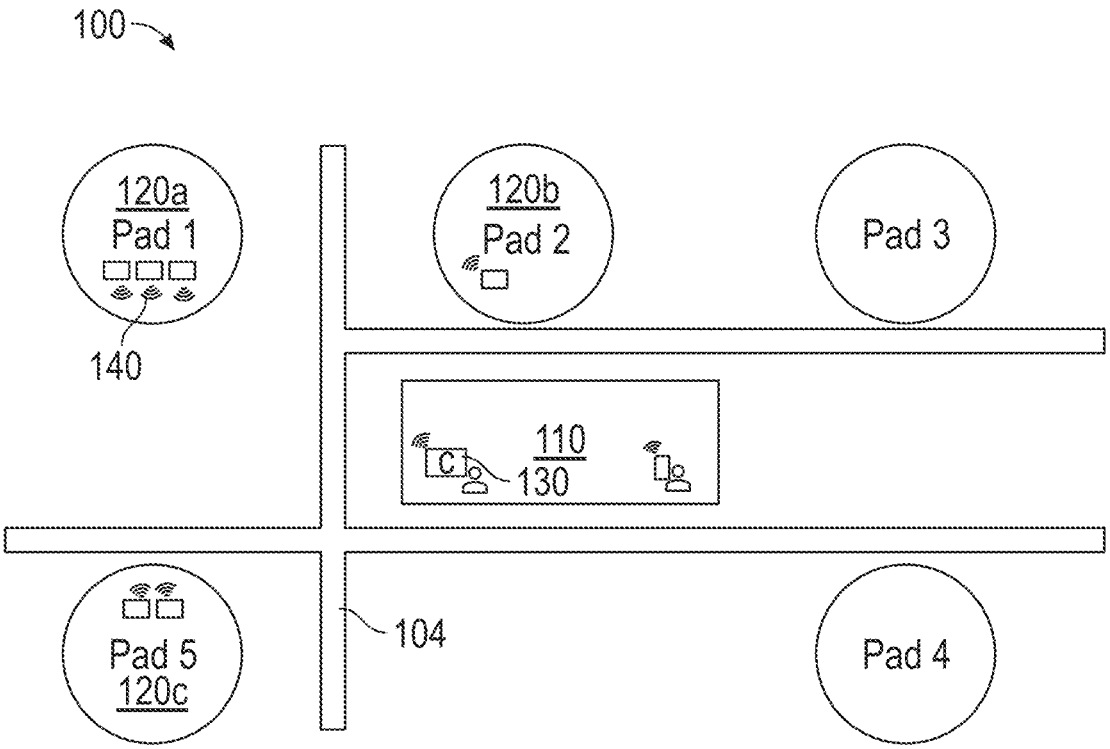
FIG. 7 shows a well system according to embodiments of the present disclosure.
Figure 8:
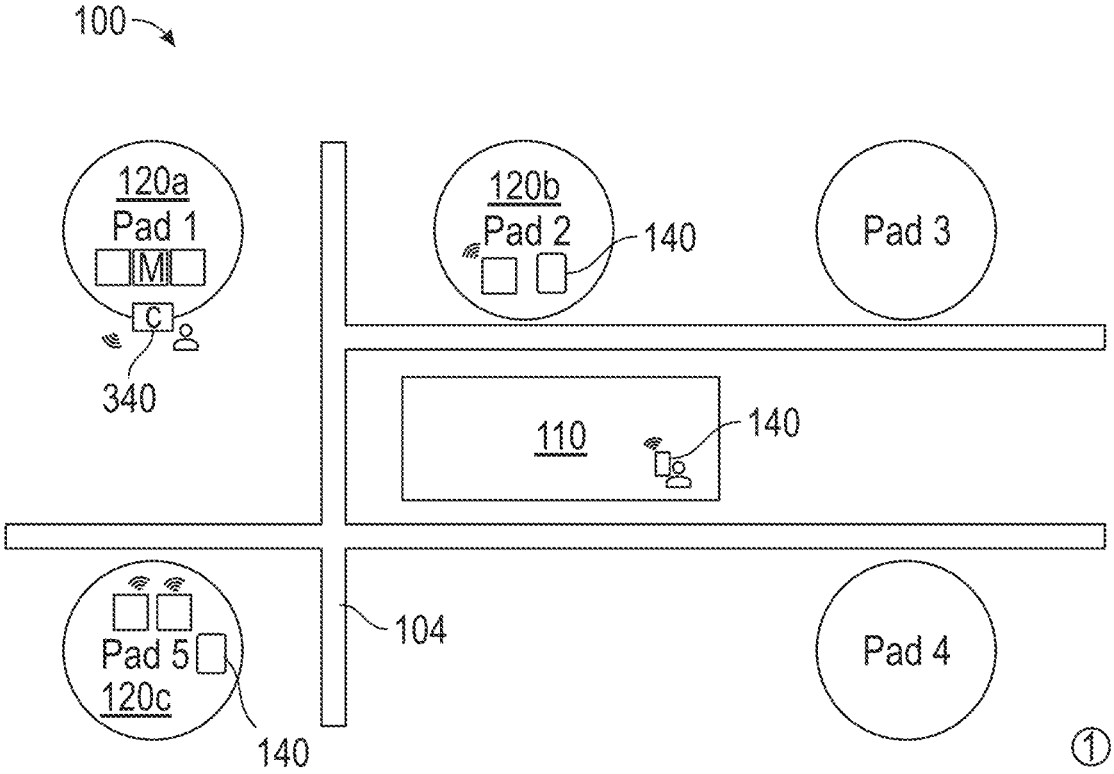
FIG. 8 shows another well system according to embodiments of the present disclosure.

Well systems 100 according to embodiments of the present disclosure may be operated, at least in part, using a control system having different subsystems provided on different pad locations in the well system. The control system subsystems include a central operation system and one or more remote operation systems, where the central operation system may be used to operate and receive/send data from/to the remote operation systems. Thus, a central operation system may be in wired or wireless communication with each remote operation system in a well system, e.g., using Wi-Fi, cellular, satellite, ethernet cable, etc. Additionally, a central operation system may be located on a pump pad or a well pad. For example, as shown in FIG. 7, a pump pad 110 may include a central operation system 130, which may be used to selectively operate the remote operation systems 140 located on the different well pads 120*a-c* in a well system 100. In other embodiments, such as shown in FIG. 8, a central operation system 130 may be located on a well pad 120*a*, and remote operation systems 140 may be located on the pump pad 110 and any other well pads 120*b-c* in the well system 100. Thus, a central operation system may be located on one of the pump pad 110 or a well pad 120, while remote operation system(s) 140 may be located on any other pad locations in the well system 100.

A central operation system 130 may include a primary computer system with a primary user interface. The primary computer system may also include computing components such as one or more processors, memory (e.g., working memory, short-term memory, or long-term memory), secondary storage devices, an input, an output, and a power supply. The primary computer system may execute instructions using one or more processors for receiving data from each remote operation system in the well system, sending commands and/or data to the remote operation systems, and/or processing data (e.g., for data analysis, data presentation, etc.). In some embodiments, a central operation system may also include sensors and/or controllers for monitoring and controlling equipment in the pad location in which the central operation system is located. Components in a central operation system may be in wired or wireless communication with each other, e.g., using Wi-Fi, cellular, satellite, cables, etc.

A remote operation system 140 may include a remote computer system in communication (wired or wireless) with the primary computer system, controllers located on equipment in the pad location capable of controlling one or more functions in the equipment, and/or sensors located on equipment in the pad location. For example, one or more sensors may be provided on equipment in a pad location with a remote operation system 140, where the sensors may sense one or more equipment parameters (e.g., pressure, temperature, off/on status, valve open/close status, fluid flow rate, etc.) and send equipment parameter data to the remote computer system. In another example, one or more electronic controllers for equipment, such as a valve controller, may be in communication with and operated by the remote computer system. Components in a remote operation system may be in wired or wireless communication with each other, e.g., using Wi-Fi, cellular, satellite, cables, etc.

Similar to the central computer system, a remote computer system may include computing components such as one or more processors, memory (e.g., working memory, short-term memory, or long-term memory), secondary storage devices, an input, an output, and a power supply. The remote computer system may execute instructions using one or more processors for receiving and processing data from sensors, controllers, and/or other electronic devices in communication with the remote operation system 140. The remote computer system may also execute instructions for sending and receiving signals from the central computer system (e.g., for sending operational data to the central computer system or for receiving operational commands from the central computer system).

In contrast to the central computer system 130, which may communicate (wired or wireless communication) with each remote operation system in the well system, a remote operation system 140 may be singly in communication with the central computer system 130. For example, data related to one or more equipment units on a pad location may be sent from a remote computer system in a remote operation system 140 to the central operation system 130. The central operation system 130 may process the data received from the remote operation system 140, which may be used to make operational decisions for the well system 100. The central operation system 130 may then send commands to one or more remote operation systems 140 in the well system 100 to execute the operational decisions.

For example, a well system 100 may include a pump pad 110 and multiple remotely located well pads 120 fluidly connected to the pump pad 110 via flexible pipe 102. A central operation system may be located on a first well pad 120, a first remote operation system may be located on the pump pad 110, and a second remote operation system may be located on a second well pad. The first and second remote operation systems may be in communication with the central operation system. An event in the first well pad 120 may be detected (e.g., via one or more sensors in the first well pad or by visual detection), processed, and collected by the central operation system. For example, the event may be an event that requires well shut down and/or repair on the first well pad. In such event, the central operation system may generate one or more commands that may be sent to the first remote operation system on the pump pad 110 to stop fluid flow from the pump pad 110 to the first well pad 120. In some embodiments, the central operation system may generate one or more signals based on collected event data from the first well pad 120 to send to the first remote operation system on the pump pad 110 and control fluid flow from the pump pad 110 to the second well pad and the first well pad (e.g., to stop fluid flow the first well pad and start fluid flow to the second well pad).

Well System Setup

As described above, well systems 100 according to embodiments of the present disclosure may be assembled using lines of flexible pipe 102 fluidly connecting a pump pad 110 to one or more remotely located well pads 120. For example, a line of flexible pipe 102 may extend at least 500 feet to connect pumping equipment in a pump pad 110 to a well manifold in a well pad 120. Conventionally, fluidly connecting pumping equipment to remotely located well equipment would require extensive planning and assembly time (e.g., connecting rigid tubulars segment by segment until reaching the remote location). However, embodiments of the present disclosure may use a pipe deployment system capable of spooling and unspooling flexible pipe 102 to lay lines of flexible pipe 102 across remote distances (e.g., greater than 100 feet, greater than 500 feet, or greater than 1,000 feet), thereby reducing well system setup time and costs.

Pipe deployment systems according to embodiments of the present disclosure may include a deployment tool and a spool of flexible pipe. The deployment tool may be maneuvered to deploy flexible pipe in a well system and/or to remove flexible pipe from a well system by spooling and unspooling the flexible pipe from a spool mounted to the deployment tool. As described in more detail below, the flexible pipe may be spooled/unspooled from the deployment tool as the deployment tool and an end of the flexible pipe are moved apart or toward each other (thereby applying a tension to the flexible pipe). In some embodiments, the deployment tool may be attached to a vehicle, which may move the deployment tool relative to an end of the flexible pipe in a fixed location to spool/unspool the flexible pipe.

Figure 9:
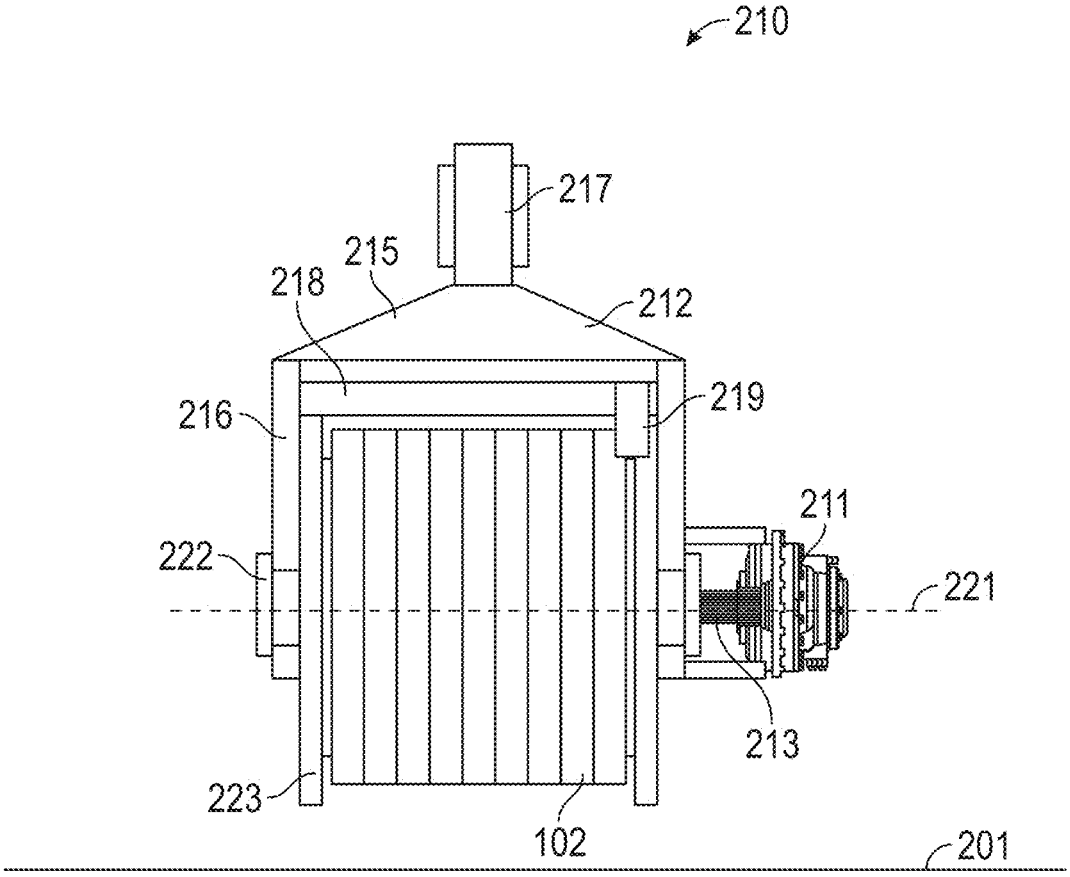
FIGS. 9 and 10 show a pipe deployment system according to embodiments of the present disclosure.
Figure 10:
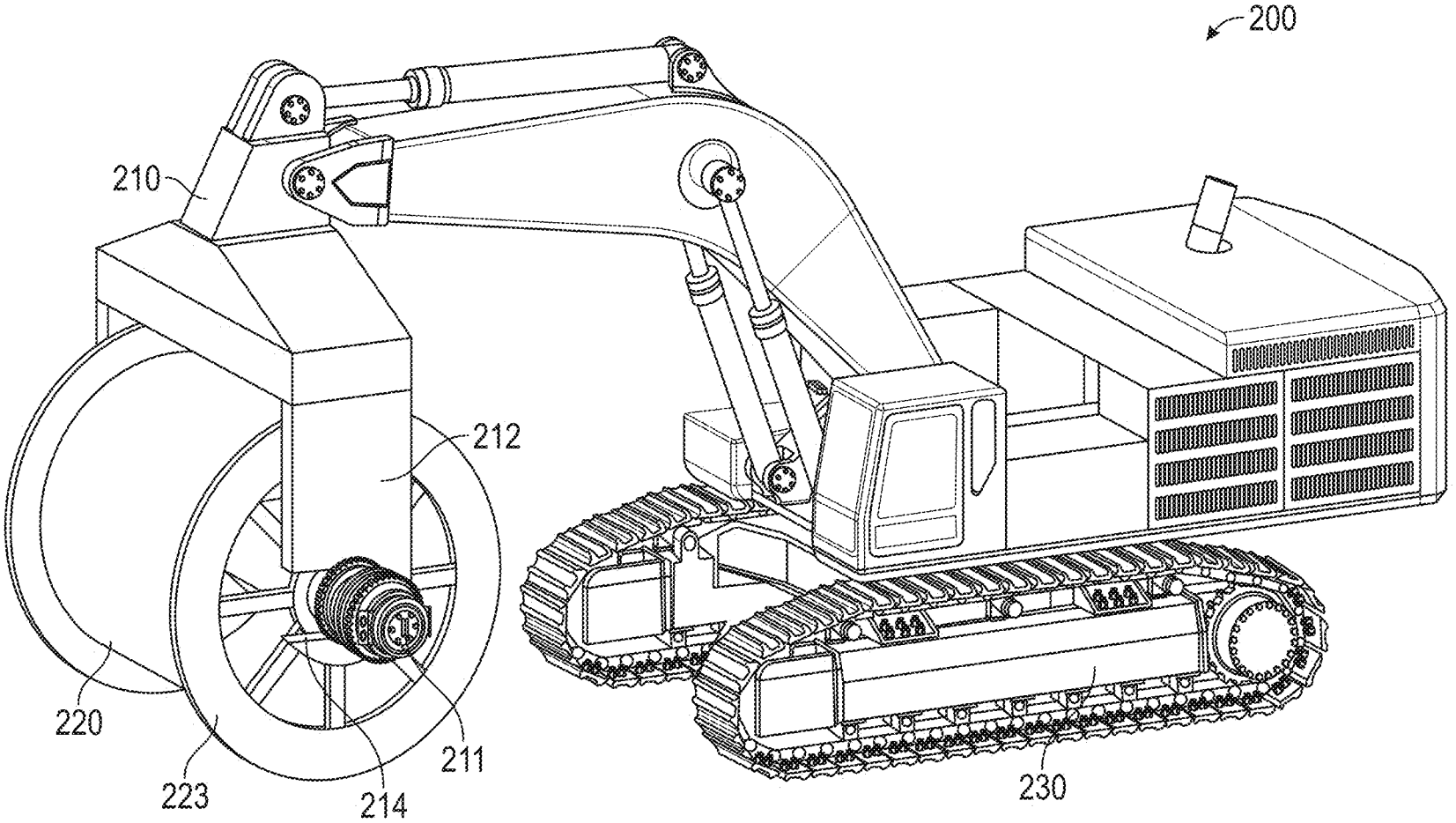

FIGS. 9 and 10 show an example of a pipe deployment system 200 according to embodiments of the present disclosure that includes a deployment tool 210 used to spool or unspool flexible pipe 102 from a spool 220. Particularly, FIG. 9 shows a spool 220 of flexible pipe 102 mounted to the deployment tool 210, and FIG. 10 shows the deployment tool 210 attached to a vehicle 230, which may be used to move the deployment tool 210 to spool or unspool the flexible pipe 102.

The spool 220 may have a generally cylindrical body around which flexible pipe 102 may be wound. The spool 220 may also have end guards 223 at opposite axial ends of the body, where the end guards 223 may extend radially farther from the spool's rotational axis 221 than body (such that the diameter of the end guards 223 is greater than the diameter of the body). The end guards 223 may be used to prevent flexible pipe 102 from coming off the axial ends of the spool 220. Additionally, a connection end may be provided at one or both axial ends of the spool 220 for connection to the deployment tool 210. In the embodiment shown, pins 222 may extend axially along the rotational axis 221 of the spool 220 and outwardly from each axial end of the spool, where the pins 222 may be used for connection to the deployment tool 210.

Generally, a deployment tool 210 may include a body 212 having at least one spool engagement slot 214. The connection end(s) (e.g., pins 222) of a spool 220 may engage with the engagement slot(s) 214 to rotatably connect the spool 220 to the deployment tool 210. The structure of the deployment tool body 212 may be designed to have different configurations depending on, for example, the desired orientation of the spool 220 during spooling/unspooling, the type of vehicle 230 that is to be used to maneuver the deployment tool 210, the size of the spool 220, and manufacturing considerations. In the example embodiment shown in FIGS. 9 and 10, the deployment tool 210 includes two spaced apart spool engagement slots 214, which may rotatably hold the spool 220 in a generally horizontal position, where the rotational axis 221 of the spool 220 may be generally parallel with the ground 201. In other embodiments, such as described in more detail below with respect to FIGS. 19 and 20, a deployment tool may include a single engagement slot that may be used to rotatably hold a spool in a generally vertical position.

As shown in FIGS. 9 and 10, the deployment tool body 212 may include a support structure 215, which may have a generally elongated shape, two arms 216 extending in a first direction from the support structure 215, and an attachment portion 217 positioned on a side of the support structure 215 opposite the two arms 216. Each of the arms 216 may have one of the two engagement slots 214 formed through the arm 216, where the two engagement slots 214 may be formed at a shared position along the length of the arms 216. The engagement slots 216 may be formed through the entire thickness of the arms 216, as shown in FIGS. 9 and 10, such that the pins 222 of the spool 220 may extend entirely through the thickness of the arms 216. In other embodiments, an engagement slot may be formed through a partial thickness of a deployment tool body.

The attachment portion 217 of the deployment tool body 212 may be integrally formed with the support structure 215 or may be attached to the support structure 215 (e.g., via welding or fasteners). The attachment portion 217 of the deployment tool body 212 may be used to connect the deployment tool 210 to a vehicle 230. Thus, the attachment portion 217 may be designed to connect with a selected type of vehicle 230. For example, in the embodiment shown in FIGS. 9 and 10, the deployment tool 210 may be connected to an excavator, where the attachment portion 217 may be designed to connect to the boom of the excavator via one or more through bolt connections.

A deployment tool 210 may also include a hydraulic motor 211 mounted to the body 212 in a location capable of engaging a mounted spool 220 via an engagement spline 213. The hydraulic motor 211 may be a radial piston hydraulic motor. Other suitable motors that may be used with deployment tools according to embodiments of the present disclosure include, for example, other types of hydraulic motors, electric motors, or pneumatic motors. When the spool 220 is mounted to the deployment tool 210, the engagement spline 213 may be manually or automatically moved to rotationally engage the hydraulic motor 211 with a connection end (e.g., a pin 222) of the spool 220. For example, a hydraulic actuated device, such as a hydraulic cylinder, may be used push the engagement spline 213 in or out from the motor 211 into the connection end of the spool 220. According to embodiments of the present disclosure, an engagement spline 213 may have a generally rod-like shape with a locking profile of one or more interlocking features (e.g., a plurality of grooves) around a first axial end. The first axial end of the engagement spline 213 may be inserted into a central cavity in the spool 220 having a receiving profile with corresponding interlocking features formed along the inner surface of the central cavity, where the interlocking features of the engagement spline 213 may engage with and interlock with the corresponding interlocking features of the central cavity in the spool 220. Once in an interlocking configuration, rotation of the engagement spline 213 by the hydraulic motor 211 may consequently rotate the connected spool 220.

When a spool 220 is mounted to the deployment tool 210 and engaged with the hydraulic motor 211, flexible pipe 102 may be reeled or unreeled around the spool body. During reeling, a follower 219 may be used to guide the flexible pipe 102 in consecutive and adjacent coils around the spool 220 to wind the flexible pipe 102 around the spool 220 During unreeling, the follower 219 may be used to keep the flexible pipe 102 axially in place as it is being unreeled. The follower 219 may be movable along a guide bar 218 provided on the deployment tool 210 that extends parallel with the rotational axis 221 of the spool 220. The follower 219 may move back and forth along the length of the guide bar 218 (and thus also along an axial length of the spool) as the spool 220 rotates in the deployment tool 210. Additionally, the follower 219 may move at a speed commensurate with the rotational speed of the spool 220 such that the follower 219 may consistently be positioned next to and guide the portion of the flexible pipe 102 coming off of or being wound onto the spool 220 as the flexible pipe 102 is unreeled or reeled, respectively. Followers 219 may be moved along a guide bar 218 using power from the hydraulic motor 211, from a separate power source, or using other means known in the art.

Figure 11:
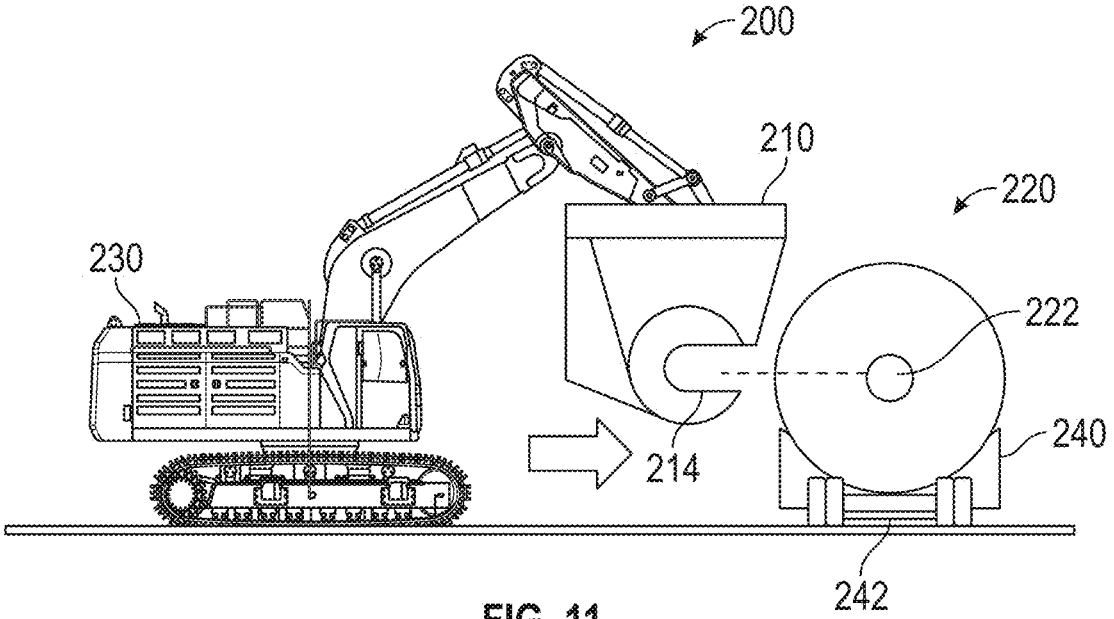
FIGS. 11-14 show methods for using a pipe deployment system according to embodiments of the present disclosure.

FIGS. 11-14 show an example of reeling and unreeling flexible pipe 102 from a spool 220 using a pipe deployment system 200 according to embodiments of the present disclosure. In FIG. 11, a spool 220 of flexible pipe 102 may be provided, e.g., on a spool transportation skid 240 and/or a trailer 242. The spool 220 of flexible pipe 102 may then be mounted to a deployment tool 210.

According to embodiments, the spool 220 may be mounted to a deployment tool 210 by moving the deployment tool toward the spool with an engagement slot(s) 214 of the deployment tool 210 in alignment with a connection end(s) (e.g., pins 222) of the spool 220. For example, as shown in FIG. 11, when the deployment tool 210 is connected to a vehicle 230, the vehicle 230 may move the deployment tool 210 toward the spool 220 at a height above the ground where the engagement slots 214 of the deployment tool 210 is approximately the same height as that of the pins 222 of the spool 220. When the engagement slots 214 of the deployment tool 210 are aligned with the pins 222 of the spool 220 and the deployment tool 210 is moved into contact with the spool 220, the pins 222 may fit into the engagement slots 214, thereby mounting the spool 220 to the deployment tool 210. In some embodiments, the engagement slots 214 may be held in an upwardly slanting orientation to prevent roll out of the pins 222. After the spool 220 is mounted to the deployment tool 210, an engagement spline may be extended from a hydraulic motor 211 on the deployment tool 210 to engage with and interlock with the pins 222 of the spool 220, thereby rotatably connecting the spool 220 to the deployment tool 210.

In some embodiments, a locking mechanism may be provided in or around an engagement slot 214, which may be used to lock the spool 220 into the deployment tool 210 after the spool has been mounted to the deployment tool. For example, a locking mechanism may be configured to extend at least partially across the distance of the engagement slot opening, such that the spool connection end is unable to slide out of the engagement slot while the locking mechanism is in the locked position. In the embodiment shown in FIG. 12, a locking mechanism 260 may be a locking bar, where after the spool 220 has been mounted in the deployment tool 210, the locking bar may be extended from one side of the engagement slot 214 to the opposite side of the engagement slot to prevent the connection end of the spool from sliding out of the engagement slot.

Figure 12:
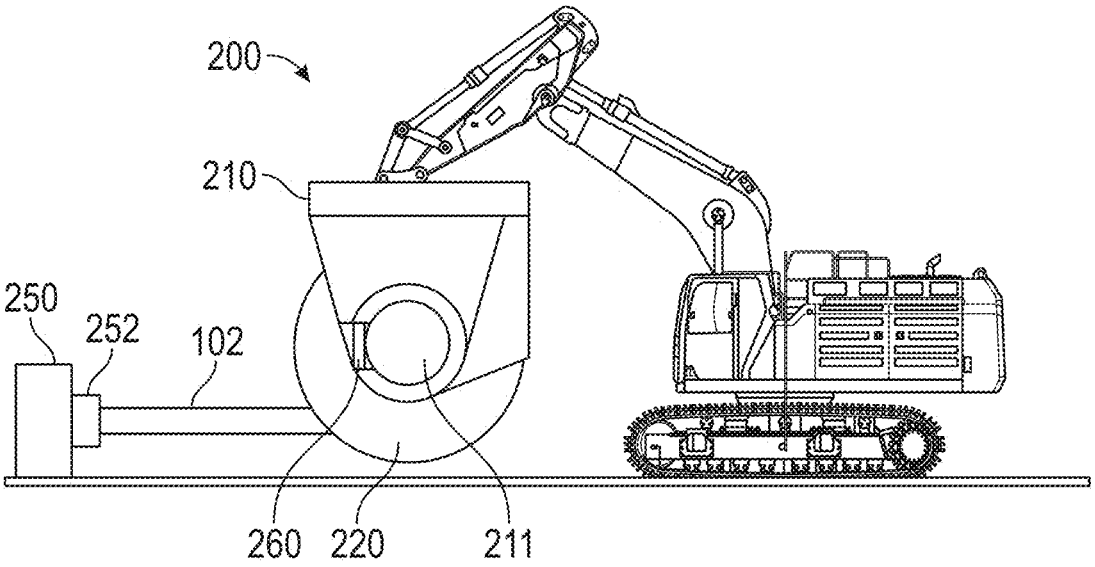

As shown in FIG. 12, an assembled pipe deployment system 200 may be used to deploy the flexible pipe 102, e.g., to connect a pump pad 110 to a well pad 120. For example, the spool 220 of flexible pipe 102 may be brought to a well system equipment 250 (e.g., a manifold, a well or frac stack, or other equipment described above with respect to FIGS. 2-4) using the vehicle 230. In some embodiments, such as shown in FIGS. 2, 5, 6, and 7, the vehicle 230 may transport the spool 220 long distances over roads 104 between different pads in a well system. At the well system equipment 250, a first end of the flexible pipe 102 may be connected to the well system equipment 250 using a connector 252 (e.g., a clamp or flange). When the first end of the flexible pipe 102 is connected to the well system equipment 250, the deployment tool 210 may be moved in a direction away from the well system equipment 250 using the vehicle 230 to unreel the flexible pipe 102 from the spool 220.

As the deployment tool 210 is moved and the flexible pipe 102 is unreeled, the hydraulic motor 211 may rotate the spool 220 at a rotational speed commensurate with the speed of the vehicle 230 (and thus deployment tool 210) such that a constant tension in the flexible pipe 102 between the connected well system equipment 250 and deployment tool 210 is maintained. For example, a deployment tool 210 may include at least one sensor for measuring data corresponding with the tension in the flexible pipe 102 as it is reeled and unreeled, such as a torsion sensor positioned along the spool, engagement spline, and/or a component of the hydraulic motor to measure torque in the system, a strain gauge, a sensor for measuring rotational speed of the spool, and/or pressure sensors. The data corresponding to tension in the flexible pipe 102 may be used to control the hydraulic motor 211 to maintain a selected tension in the pipe.

In some embodiments, a hydraulic motor 211 may include a pressure control valve for controlling flow of hydraulic fluid in the hydraulic motor 211, where the pressure control valve may be set to a selected pressure limit (e.g., between 1.5 kpsi and 2.5 kpsi). When the amount of torque in the motor generates a pressure greater than the selected pressure limit of the pressure control valve, the pressure control valve may automatically release some of the pressure in the hydraulic fluid system in the motor to maintain the pressure under the selected pressure limit, thereby also limiting the torque from the motor and tension in the flexible pipe 102. Additionally, pressure control of the hydraulic fluid system in the hydraulic motor 211 may be used to maintain a tension in the flexible pipe 102 in both directions of reeling and unreeling (e.g., as the deployment tool 210 is moved closer to or farther away from the fixed end of the pipe). For example, if during unreeling the flexible pipe 102 the vehicle 230 (and thus deployment tool 210) changes direction, the hydraulic motor 211 may automatically reverse the rotation of the spool 220 to reel in the flexible pipe 102, thereby maintaining a tension in the flexible pipe 102.

Figure 13:
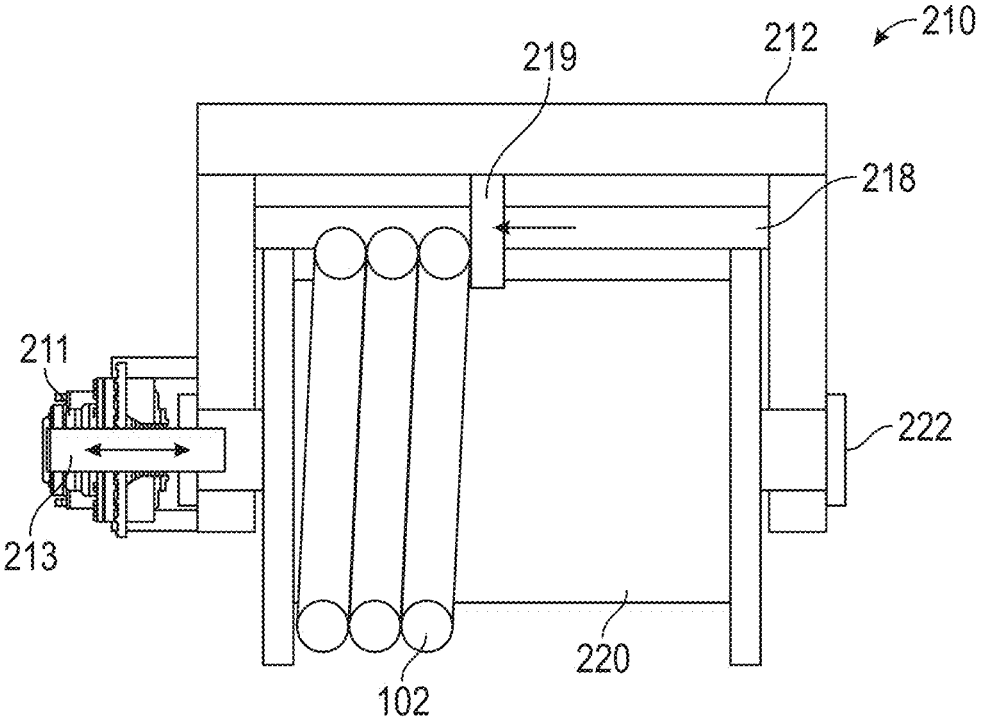

Referring back to FIGS. 12 and 13, as the flexible pipe 102 is unreeled from the spool 220 for deployment in a well system, a follower 219 (connected to the spool or the deployment tool via a guide bar 218) may be used to keep the flexible pipe 102 tightly wrapped around the spool 220 during deployment. For example, when the flexible pipe 102 is being unreeled, as shown in FIGS. 12 and 13, the follower 219 may slide axially along the guide bar 218 in a direction toward the flexible pipe 102 to maintain contact pressure from the follower 219 on the flexible pipe 102.

Figure 14:
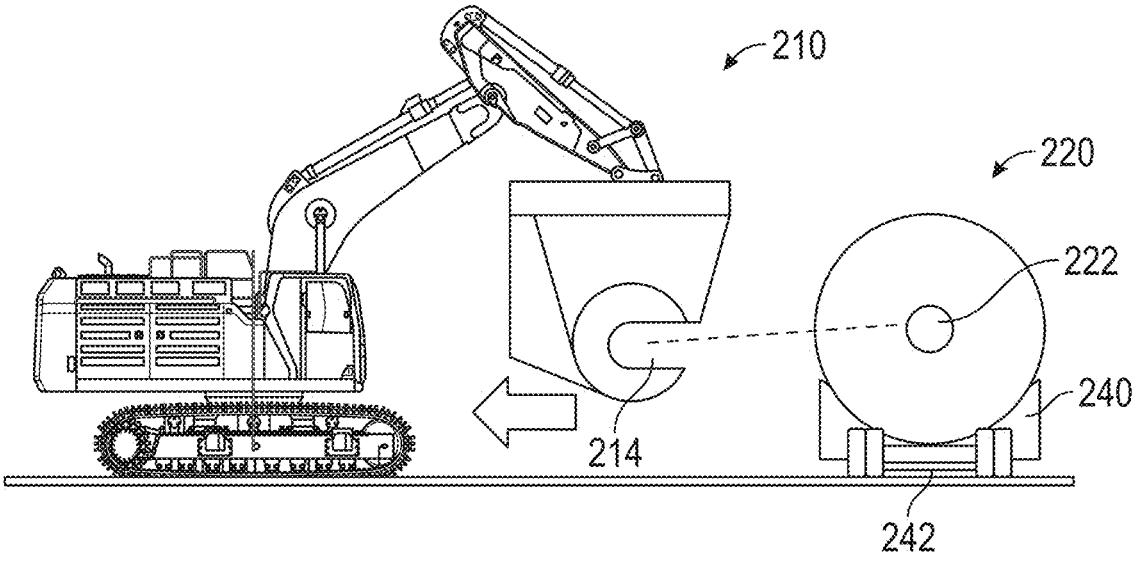

As shown in FIG. 14, after the flexible pipe 102 has been unreeled, deployed, or otherwise no longer needed, the vehicle 230 may bring the deployment tool 210 and connected spool 220 to a drop-off location, which may be the same spool transportation skid 240 and/or a trailer 242 that supplied the spool 220 or other location. The vehicle 230 may drop-off the spool 220, for example, by lowering the spool 220 to the ground or other drop-off location surface. Friction between the drop-off location surface and the spool or other type of holding mechanism may be used to hold the spool 220 in places as the deployment tool 210 is moved in a direction away from the spool 220, thereby dismounting the spool 220 from the deployment tool 210.

Other types of vehicles or machines may be used to move a deployment tool 210 relative to a spool 220 for mounting and dismounting the spool 220 to the deployment tool 210 and/or for moving an end of a flexible pipe 102 relative to the deployment tool 210 for reeling or unreeling the flexible pipe 102 from the spool 220 on the deployment tool 210. For example, FIGS. 15-18 show an example of methods and systems according to embodiments of the present disclosure where a bulldozer is used as the vehicle 230 for moving a deployment tool 210 to mount/dismount a spool 220 and deploy flexible pipe from the spool 220. In the embodiment shown, the deployment tool 210 may be configured to connect to the front end of the bulldozer (replacing where a bulldozer blade would otherwise be).

Figure 15:
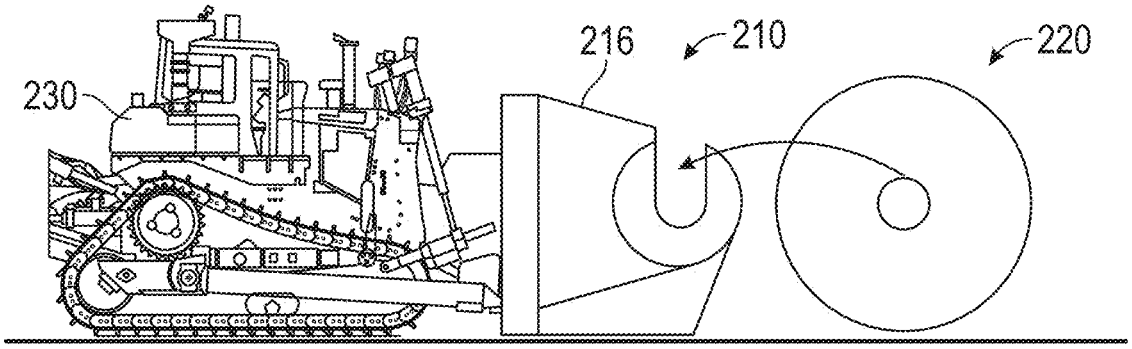
FIGS. 15-18 show a pipe deployment system according to embodiments of the present disclosure.

As shown in FIG. 15, the vehicle 230 may move the deployment tool 210 to the spool 220 for mounting the spool 220 to the deployment tool 210. The spool 220 may be mounted to the deployment tool 210 by either moving the spool 220 to fit the connection ends of the spool into the engagement slots of the deployment tool or by maneuvering (e.g., rotating and linearly moving) the deployment tool to align the engagement slots of the deployment tool with the connection ends of the spool. Once mounted, an engagement spline may be used to engage the hydraulic motor 211 of the deployment tool 210 with the spool 220.

Figure 16:
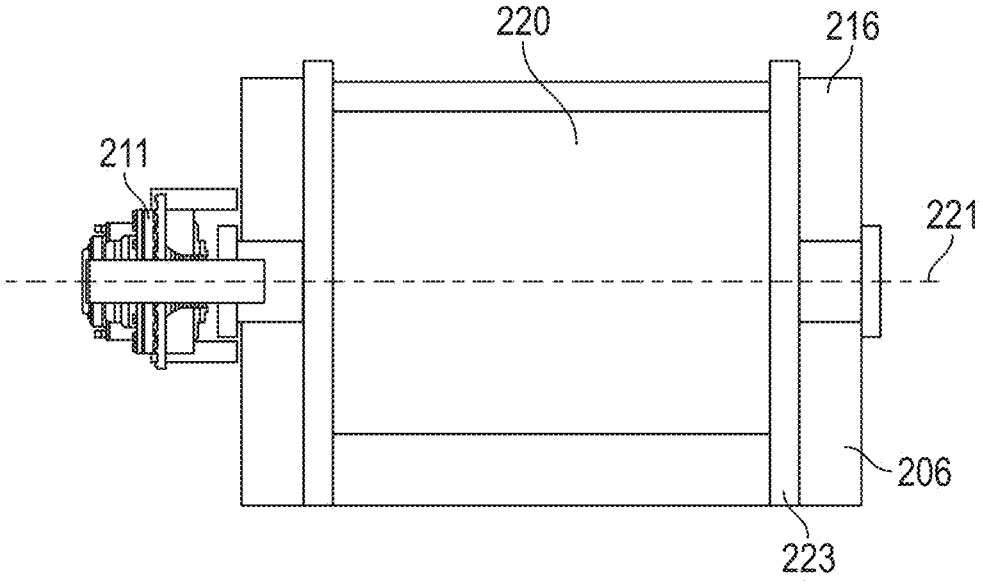
Figure 17:
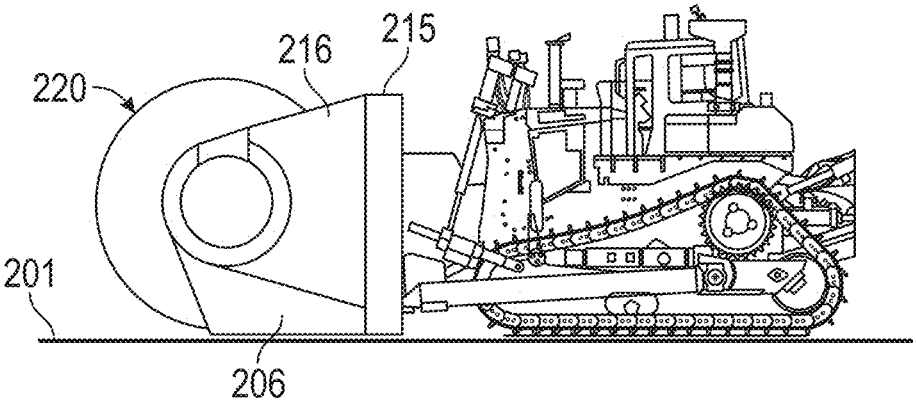

As shown in FIGS. 16 and 17, the vehicle 230 may move the assembled spool and deployment tool with the deployment tool 210 in a lateral direction, where the arms 216 of the deployment tool 210 extend from the deployment tool support structure 215 in a direction that is generally parallel with the ground 102. In the lateral direction, the deployment tool 210 may carry the spool 220 in an orientation where the rotational axis of the spool 220 is also generally parallel with the ground 102. In such embodiments, the deployment tool 210 may be provided with a drag plate 206 at a bottom side of the deployment tool arms 216 to protect the spool 220 from hitting the ground 201. For example, as best seen in FIG. 16, the drag plate 206 may extend a radial distance from the rotational axis 221 of the spool 220 that is greater than the radial distance of the end guards 223 of the spool 220. In such configuration, the drag plate 206 may contact the ground 201 before the spool 220 in instances of uneven ground 201 or bumps during movement, thereby protecting the spool 220. The drag plate 206 may be attached to or integrally formed with the arms 216 of the deployment tool.

Figure 18:
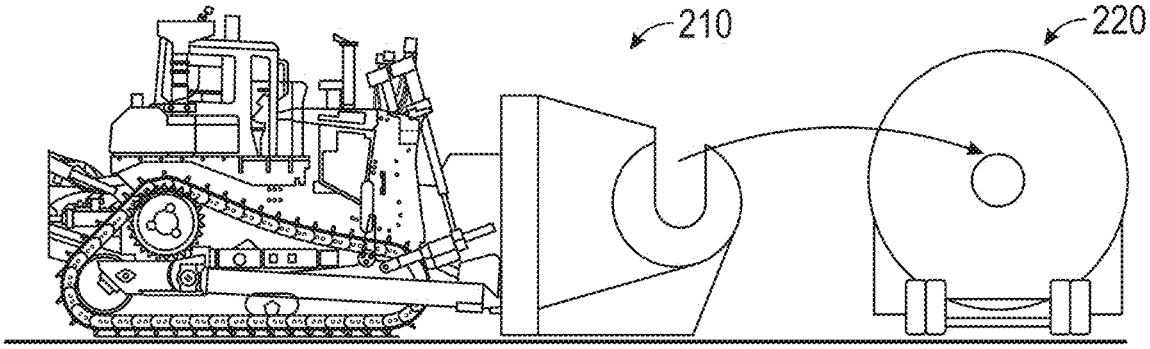

As shown in FIG. 18, the spool 220 may be dropped off after use at a drop-off location. The spool 220 may be dismounted from the deployment tool 210, for example, by rotating and linearly moving the deployment tool 210 using the vehicle 230 to slide the spool connection ends out of the deployment tool engagement slots.

Figure 19:
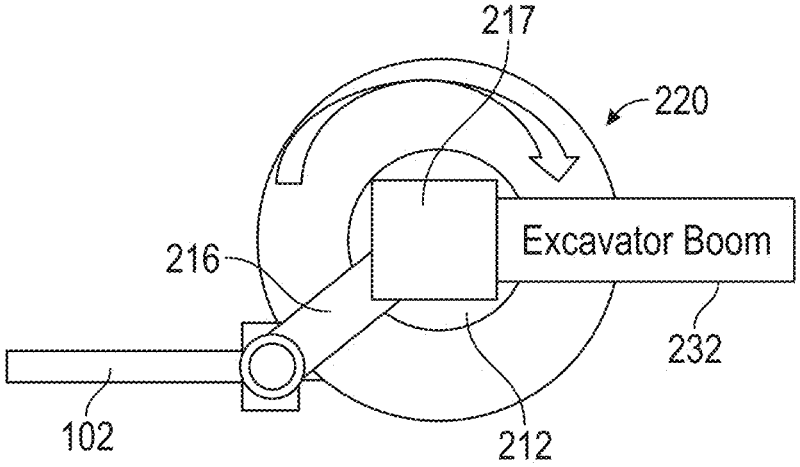
FIGS. 19 and 20 show a pipe deployment system according to embodiments of the present disclosure.
Figure 20:
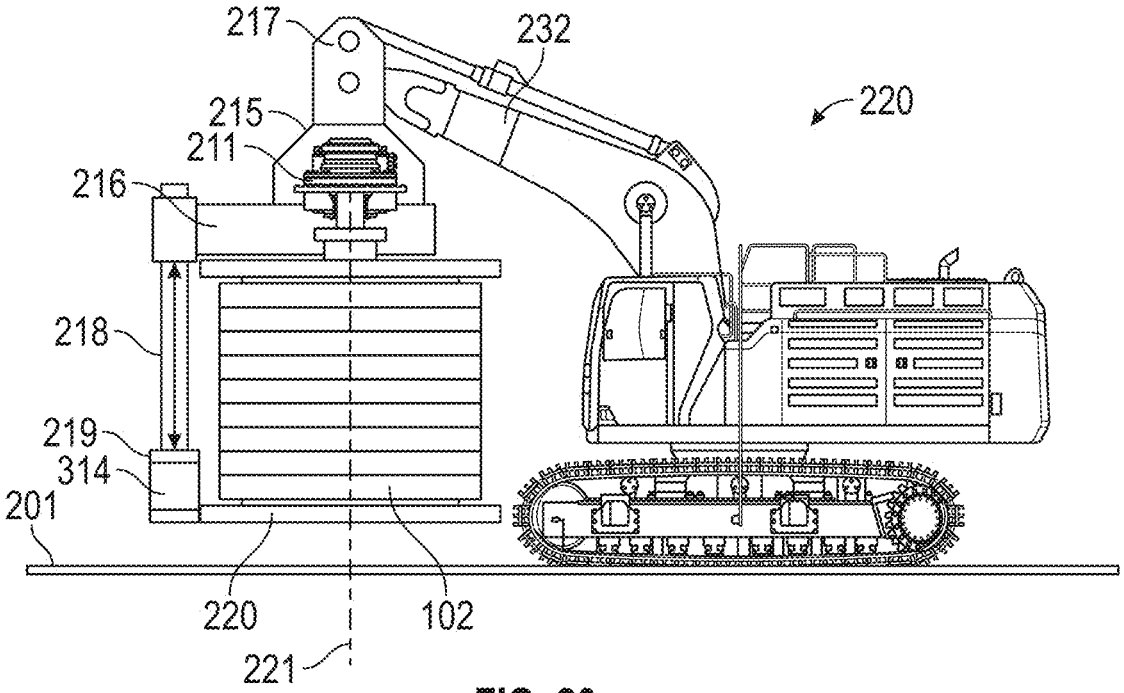

FIGS. 19 and 20 show another example of a pipe deployment system according to embodiments of the present disclosure, where an excavator is used as the vehicle 230 for deployment. In contrast to the pipe deployment systems using an excavator shown in FIGS. 10-14, where the deployment tool 210 was hung from the excavator boom in a horizontal position (to orient the rotational axis 221 of the spool generally parallel with the ground), the pipe deployment system shown in FIGS. 19 and 20 uses an axially hanging deployment tool 210 in a vertical position to deploy flexible pipe 102 from the deployment tool 210 while the rotational axis 221 of the spool 220 is held in an orientation generally perpendicular to the ground 201.

As shown, the axially hanging deployment tool 210 may include a body 212 having a support structure 215 and a single arm 216 extending laterally from the support structure 215. The support structure 215 may include a housing portion, which houses the hydraulic motor 211. The deployment tool 210 may include a single engagement slot 214 formed through the arm 216 of the deployment tool body 212, where a connection end of the spool 220 may be inserted into the engagement slot 214 to be rotationally retained by the deployment tool 210. The body 212 may also include an attachment portion 217 positioned on a side of the support structure 215 opposite of the arm 216. The attachment portion 217 may be used to connect the deployment tool 210 to the vehicle 230, at an end of the excavator's boom 232.

When the spool 220 is mounted to the deployment tool 210, the spool 220 may be rotatably held in a vertical orientation, such that the rotational axis 221 of the spool 220 is generally perpendicular to the ground 201. The hydraulic motor 211 may be engaged with the connection end of the spool 220 (e.g., via an engagement spline) to rotate the spool 220 and reel/unreel flexible pipe 102 as the spool 220 is held in the vertical orientation.

In the embodiment shown, a guide bar 218 may be connected to an axial end of the arm 216, where the guide bar 218 may extend from the axial end of the arm 216 a direction parallel with the rotational axis 221 of the spool 220 along the length of the spool 220. A follower 219 may be slidably connected to the guide bar 218, where the follower 219 may slide up and down the guide bar 218. The follower 219 may be used to keep the flexible pipe 102 in a fixed position relative to the spool 220 during reeling or unreeling the flexible pipe 102. Particularly, the follower 219 may include a channel 314 through which the flexible pipe 102 may be threaded and thereby retained during reeling/unreeling. As pipe 102 is reeled/unreeled through the channel 314, the follower 219 may make sure the flexible pipe 102 is wrapped tightly around the spool 220 (e.g., each sequential coil of the pipe wrapped tightly next to the previous coil).

Other large vehicles or machines may be used to move and deploy spools of flexible pipe according to embodiments of the present disclosure. For example, because spools of flexible pipe may often be too large and too heavy to move by hand or by simple hand carts, and because construction vehicles may often be present at well systems for other purposes, embodiments of the present disclosure include deployment tools having attachment portions that may connect to such construction vehicles. Additionally, use of large vehicles or other machines may allow for loading and unloading a spool from a transportation skid or trailer. For example, FIGS. 21 and 22 show an example of a spool 220 and spool transport to demonstrate potential scales of spool size and weight that may be deployed using pipe deployment systems according to embodiments of the present disclosure.

Figure 21:
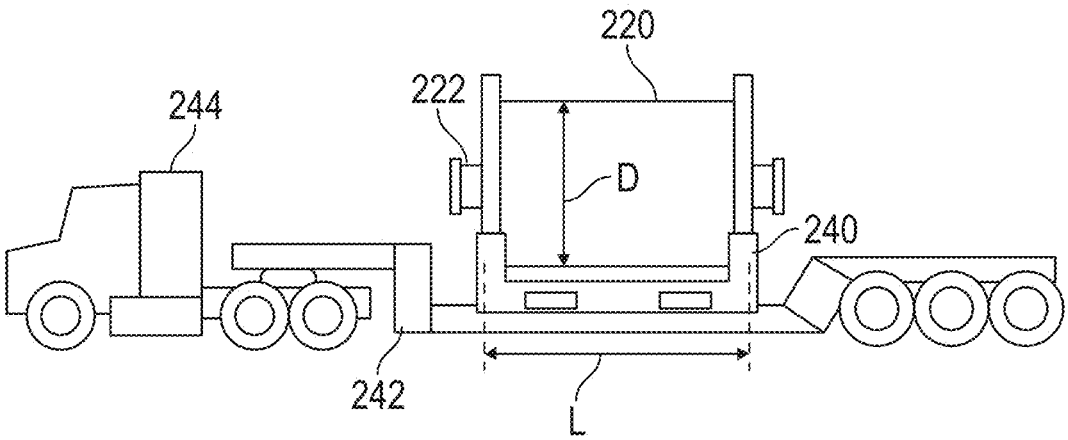
FIGS. 21 and 22 show spool transportation methods according to embodiments of the present disclosure.
Figure 22:
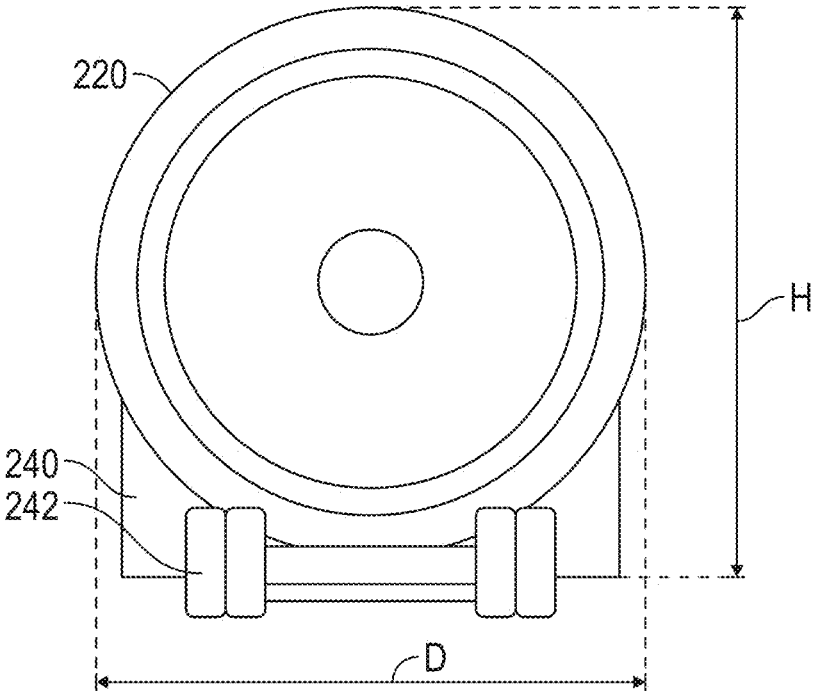

As shown in FIG. 21, a spool 220 may have an axial length L and a diameter D. The diameter D of the spool 220 may be measured along the portion of the spool between spool guides and around which flexible pipe is wrapped. The axial length L of the spool 220 may range, for example, from about 10 to 20 feet, and the diameter D may range, for example, from about 8 to 15 feet. However, the axial length L and diameter D of the spool 220 may be selected, for example, based on the amount of flexible pipe to be wrapped around the spool 220. For example, when carrying 350 feet of flexible pipe 102 with a diameter of about 6 inches, the spool 220 may have an axial length L of 11 feet and a diameter D of 10.75 feet. In some embodiments, spools 220 may be provided with a uniform diameter D of 10.75 feet but may vary in length L to carry different amount of flexible pipe 102. For example, a spool with a diameter of 10.75 feet may have a length L of 12.3 feet to hold up to 400 feet of flexible pipe, a length L of 13 feet to hold up to 450 feet of flexible pipe, and a length L of 14.5 feet to hold up to 500 feet of flexible pipe.

The spool 220 may be transported on a spool transportation skid 240 having a corresponding length and width in order to hold the selected spool size. In some embodiments, the spool transportation skid 240 may be transported on a trailer 242, which may be towed by a truck 244 for transport on roads. In such embodiments, the size of the spool 220 and spool transportation skid 240 may be designed to have a total height H of less than 14.5 feet from the ground when mounted on the trailer 242 in order to comply with highway height requirements for underpasses.

By using pipe deployment systems according to embodiments of the present disclosure, large spools of flexible pipe may be deployed in well systems for fluidly connecting multiple pads in the well system remotely spaced from each other. By using flexible pipe to connect remotely spaced well system pads, connection time may be significantly reduced when compared with using conventional rigid pipe, which requires segment-by-segment pipe connections to extend long distances. Additionally, using pipe deployment systems according to embodiments of the present disclosure allows for such use of flexible pipe, which would otherwise not have been possible due to the typically large size and weight of spools of flexible pipe.

According to embodiments of the present disclosure, pipe deployment systems may be used to fluidly connect well system equipment in a pump pad to well system equipment in one or more remotely spaced well pads.

Figure 23:
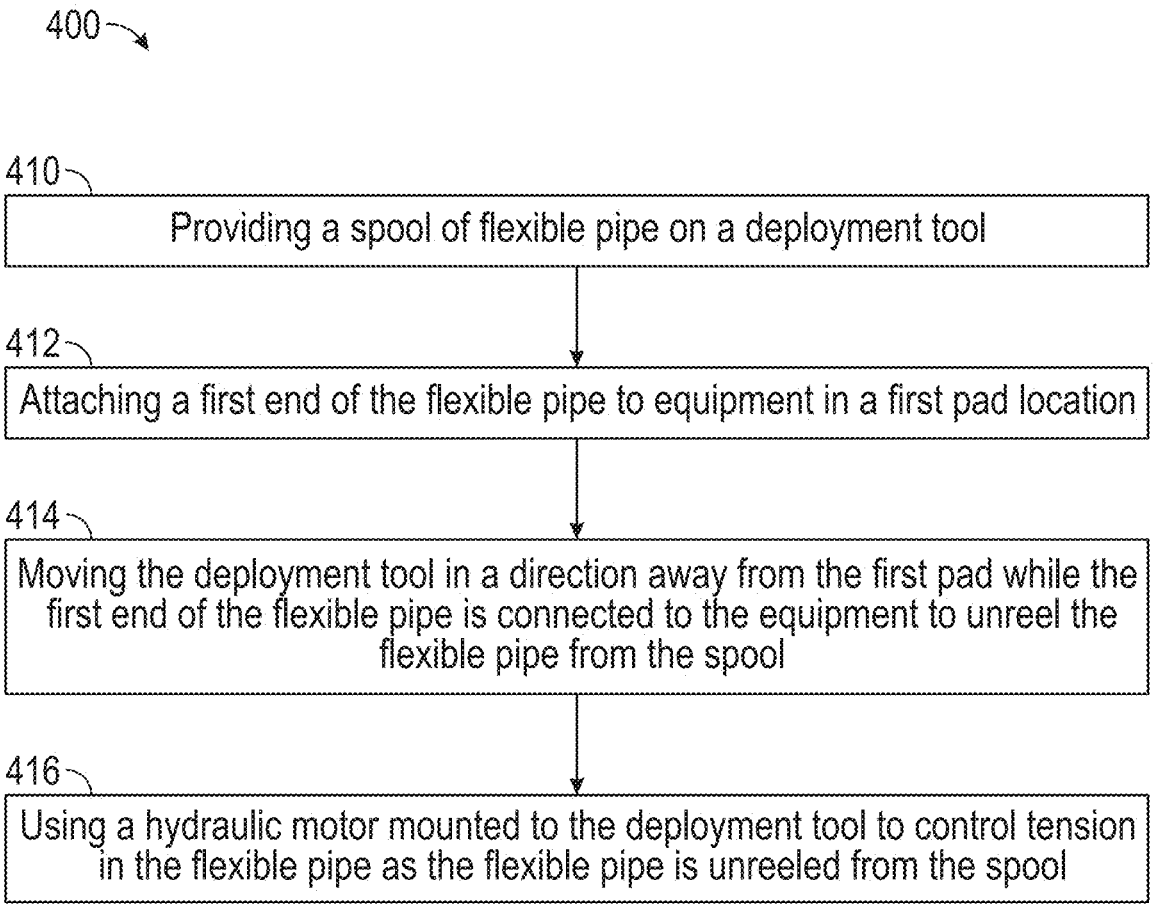
FIG. 23 shows a method according to embodiments of the present disclosure.

For example, FIG. 23 shows an example of a method for setting up a well system using a flexible pipe deployment system according to embodiments of the present disclosure. In FIG. 23, the method 400 includes providing a spool of flexible pipe on a deployment tool, step 410. A spool of flexible pipe may be provided on a deployment tool, for example, by mounting the spool to the deployment tool using methods described above with respect to FIGS. 11-18, where a vehicle may be used to maneuver the deployment tool to engage with the spool.

With the spool of flexible pipe mounted to the deployment tool, the flexible pipe may then be connected from a first pad location in a well system to a remotely spaced second pad location in the well system. To connect the flexible pipe between remotely spaced pad locations in a well system, a first end of the flexible pipe may first be attached to equipment in the first pad location, step 412. For example, the first end of the flexible pipe may be connected to a pump manifold in a pump pad of a well system. In some embodiments, the pump manifold may be fluidly connected to multiple hydraulic pumps (e.g., 16-24 pumps), such that when the flexible pipe is connected to the pump manifold, fluid may be pumped from the hydraulic pumps to the flexible pipe. In some embodiments, the first end of the flexible pipe may first be attached to well equipment in a well pad rather than equipment in the pump pad.

After the first end of the flexible pipe is connected to equipment in the first pad location, the deployment tool may then be moved in a direction away from the pump pad to unreel the flexible pipe from the spool, step 414. As the flexible pipe is being unreeled, a hydraulic motor mounted to the deployment tool may be used to control tension in the flexible pipe, step 416. For example, a pressure limit on hydraulic fluid in the hydraulic motor may be set, such that when pressure of the hydraulic fluid reaches the pressure limit, a control valve in the hydraulic motor will release to allow additional rotational spin of the spool.

The flexible pipe may be unreeled as the deployment tool moves toward a second end connection location for the flexible pipe. For example, in some embodiments, after a first end of the flexible pipe is connected to equipment in a pump pad, the flexible pipe may be unreeled until a first well pad is reached, where the first well pad may include a well manifold and a first well fluidly connected to the well manifold. When the pipe deployment system reaches the first well pad, a second, terminal end of the flexible pipe may be removed from the spool and fluidly connected to the well manifold. A second end connection (terminal connection) of a flexible pipe may be made, for example, by a person manually removing the second end of the flexible pipe from the spool and connecting the second end to equipment using a connector (e.g., a clamp, flange, or other pipe connector known in the art).

In some embodiments, a segment of flexible pipe may not be long enough to reach from a first pad to a second pad in a well system. In such embodiments, multiple segments of flexible pipe may be connected together to form the total line of flexible pipe extending between and fluidly connecting equipment in the first pad to equipment in the second pad. For example, in some embodiments, multiple segments of flexible pipe may be connected during deployment of the flexible pipe between two pads. In such embodiments, when a first segment of flexible pipe reaches its second, terminal end during unreeling, a second segment of flexible pipe may be provided (e.g., on a second spool retrieved by the same deployment tool used to unreel the first segment, or on a second spool retrieved by a second deployment tool), and the first end of the second segment may be connected to the second, terminal end of the first segment of flexible pipe. The second segment of flexible pipe may then be deployed using methods described herein, until the second segment of flexible pipe reaches the second pad in the well system or until the second segment terminates and subsequent segments are connected until the second pad in the well system is reached.

In some embodiments, multiple segments of flexible pipe already connected together may be provided on a single spool. In such embodiments, as the flexible pipe is deployed from the spool, the connected segments of flexible pipe are unreeled sequentially and in a connected-together configuration until the end destination is reached for connection of the terminal end of the line with equipment in a well system pad.

As an example, a spool of flexible pipe may include multiple segments of flexible pipe, with each segment having the necessary end connections for being connected to other segments and/or well system equipment. The multiple segments of flexible pipe may include at least two segments of flexible pipe having different segment lengths. For example, a spool may have one 400 ft segment of flexible pipe and multiple 100 ft segments of flexible pipe reeled thereon. In such embodiments, the right amount (or close to the right amount) of flexible pipe may be reeled out for the reeled line of flexible pipe to reach between and fluidly connect the well system equipment being connected, leaving extra segments of flexible pipe on the spool.

In some embodiments, a total length of flexible pipe being deployed from a deployment tool may be longer than the distance between the two well system pads being fluidly connected by the flexible pipe. In such embodiments, the total length of flexible pipe may be laid by the deployment tool in a non-linear pattern that fits the entire length of flexible pipe within the distance between the two well system pads.

According to embodiments of the present disclosure, the methods shown in FIG. 23 and described above for fluidly connecting flexible pipe between two pads in a well system may be repeated to fluidly connect a pump pad to multiple well pads in a well system, e.g., as shown in FIG. 2.

Additionally, pipe deployment systems according to embodiments of the present disclosure may be used to pick up flexible pipe in a well system. For example, flexible pipe may be picked up when reconfiguring well pad connections to a pump pad in a well system, when permanently shutting down a well pad in a well system, when replacing a damaged line of flexible pipe, moving a line of flexible pipe, or to achieve other well system design objectives.

According to embodiments of the present disclosure, flexible pipe 102 may be picked up by a pipe deployment system 200 by connecting an end of the flexible pipe 102 to a spool 220 rotatably mounted to a deployment tool 210. With the end of the flexible pipe 102 connected to the spool 220, the deployment tool 210 may be moved in a direction toward the flexible pipe 102 to reel the flexible pipe 102 onto the spool 220. For example, in the embodiment shown in FIG. 12, with an end of the flexible pipe 102 connected to the spool 220, the vehicle 230 may move the deployment tool 210 in a direction toward the opposite end of the flexible pipe (and connected well system equipment 250) to reel the flexible pipe 102 onto the spool 220. As the deployment tool 210 is moved toward the opposite end of the flexible pipe, the motor 211 may automatically rotate the spool 220 in a reeling direction (opposite the rotational direction used to unreel the pipe) to reel the pipe onto the spool 220, thereby maintaining a selected tension range in the flexible pipe 102.

In embodiments having a follower 219 provided with the pipe deployment system (e.g., connected to the deployment tool 210 or to the spool 220 via a guide bar 218), the follower 219 may be used make sure the flexible pipe 102 is wound tightly around the spool body, e.g., in a coil-by-coil and row-by-row of pipe coils.

Once a selected amount of the flexible pipe 102 has been reeled onto the spool 220, the operator may stop forward movement of the deployment tool 210. In embodiments where an entire segment or line of flexible pipe is to be reeled, once almost the entire segment or line of flexible pipe 102 (e.g., at least 95% of the length of line) is reeled onto the spool 220, the flexible pipe may be disconnected from its ground connection (e.g., the well system equipment 250 or another segment of flexible pipe) and held in place around the spool 220 (e.g., using a follower or a connector located on the spool or deployment tool). The deployment tool 210 may then be used to transport the spool of flexible pipe to another location without reeling/unreeling the pipe during such transport.

When a well system is set up, including flexible pipe extending from and fluidly connecting a pump pad to one or more well pads, operation of the connected pads may be conducted through a control system having a central operation system located on one of the pads and a remote operation system located on the rest of the pads in the well system. Operational data and commands may be sent as signals between the central operation system and the remote operation system(s) to control fluid flow through the flexible pipe between the pump pad and each of the well pads.

By setting up well systems according to embodiments of the present disclosure, including a centralized pumping location (a pump pad), multiple well pad locations may be fluidly connected to the single pumping location. By fluidly connecting well pads to a pump pad with flexible pipe, according to embodiments disclosed herein, the set up and fluid connection between the pads may be faster than if conventional type pipe connections were to be made. Additionally, by using a control system where a central operation system at a single pad location may be used to control remote operation system in each of the remaining pad locations of the well system, the central operation system may be used to monitor and control multiple well sites. For example, if one well site goes down for repair or shut down, the central operation system may divert pumping to a different well site without unnecessary operational downtime. Thus, systems and methods disclosed herein may allow for a significant increase in redundancy and efficiency, as such systems and methods may provide quick set-up well systems that may continuously run (pump fluids to well operations) even when one well site is down.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method, comprising:

providing a spool of flexible pipe on a deployment tool;

attaching a first end of the flexible pipe to a pump manifold in a pump pad, wherein the pump pad comprises hydraulic pumps fluidly connected to the pump manifold;

moving the deployment tool in a direction away from the pump pad while the first end of the flexible pipe is connected to the manifold to unreel the flexible pipe from the spool;

using a hydraulic motor mounted to the deployment tool to control tension in the flexible pipe as the flexible pipe is unreeled from the spool;

unreeling the flexible pipe until a first well pad is reached, the first well pad comprising a well manifold fluidly connected to a first well;

fluidly connecting a second end of the flexible pipe to the well manifold;

providing a central operation system on one of the pump pad or the first well pad, the central operation system comprising a primary computer system with a primary user interface;

providing a remote operation system located on the other of the pump pad or the first well pad, the remote operation system comprising a remote computer system in communication with the primary computer system and electronic controllers in the other of the pump pad or the first well pad; and sending signals between the central operation system and the remote operation system to control fluid flow through the flexible pipe.

2. The method of claim 1, wherein the unreeling further comprises connecting multiple segments of the flexible pipe in an end to end manner to extend from the pump pad to the first well pad.

3. The method of claim 1, wherein providing the spool of flexible pipe on the deployment tool comprises:

providing the deployment tool on a vehicle, wherein the deployment tool comprises a body having a spool engagement slot;

moving the vehicle toward the spool of flexible pipe until the spool engagement slot aligns with a pin extending from an axial end of the spool of flexible pipe;

engaging the spool engagement slot with the pin to interlock the pin within the spool engagement slot; and while the pin is held within the spool engagement slot, using the deployment tool to pick up the spool of flexible pipe.

4. The method of claim 3, further comprising engaging an engagement spline between the hydraulic motor of the deployment tool and the pin of the spool, wherein rotation of the engagement spline by the hydraulic motor rotates the pin.

5. The method of claim 3, wherein the spool comprises a second pin extending from an opposite axial end of the spool of flexible pipe, wherein the deployment tool comprises a second spool engagement slot in the body, and wherein moving the vehicle toward the spool of flexible pipe further comprises aligning the second spool engagement slot with the second pin.

6. The method of claim 1, further comprising:

providing a second line of flexible pipe on the spool of flexible pipe;

while the spool of flexible pipe is on the deployment tool, attaching a first end of the second line of flexible pipe to the pump manifold in the pump pad;

moving the deployment tool in a direction away from the pump pad toward a second well pad while the first end of the second line of flexible pipe is connected to the manifold to unreel the second line of flexible pipe from the spool;

using the hydraulic motor mounted to the deployment tool to control the tension in the flexible pipe as the second line of flexible pipe is unreeled from the spool; and fluidly connecting the second line of flexible pipe to a second well manifold in the second well pad.

7. The method of claim 1, further comprising setting a pressure limit on hydraulic fluid in the hydraulic motor, wherein when pressure of the hydraulic fluid reaches the pressure limit, a control valve in the hydraulic motor will release to allow additional rotational spin of the spool.

8. A method, comprising:

providing a spool of flexible pipe on a deployment tool;

attaching a first end of the flexible pipe to a pump manifold in a pump pad, wherein the pump pad comprises hydraulic pumps fluidly connected to the pump manifold;

moving the deployment tool in a direction away from the pump pad while the first end of the flexible pipe is connected to the manifold to unreel the flexible pipe from the spool;

using a hydraulic motor mounted to the deployment tool to control tension in the flexible pipe as the flexible pipe is unreeled from the spool;

using the deployment tool to connect multiple lines of the flexible pipe from the pump manifold to multiple well manifolds located in different well pads, wherein each well pad is spaced apart from each other and from the pump pad;

providing a central operation system on the pump pad, the central operation system comprising a primary computer system with a primary user interface;

providing a remote operation system located on each of the well pads, wherein each remote operation system comprises a remote computer system in communication with the primary computer system and electronic controllers in the well pad; and sending signals between the central operation system and the remote operation systems to control fluid flow through the flexible pipe between the pump pad and each of the well pads.

9. The method of claim 8, further comprising sending a signal from the central operation system to one of the remote operation systems in one of the well pads to shut down fluid flow from the pump pad to the one of the well pads.

10. A pipe deployment system, comprising:

a vehicle;

a deployment tool attached to the vehicle, the deployment tool comprising:

a body having a spool engagement slot; and a hydraulic motor mounted to the body, wherein the deployment tool is configured to deploy a flexible pipe between a pump manifold on a pump pad and a well manifold on a well pad in a well system;

a spool rotatably connected to the deployment tool by a pin extending along a rotational axis of the spool from a first end of the spool to a second end of the spool, wherein the pin is held within the engagement slot at the first end; and an engagement spline rotationally engaging the hydraulic motor with the pin at the second end.

11. The pipe deployment system of claim 10, wherein the deployment tool further comprises a follower, and wherein the follower is movable along an axial length of the spool.

12. The pipe deployment system of claim 10, wherein the hydraulic motor is a radial piston hydraulic motor.

* * * * *